US010095151B2

(12) United States Patent
Imai et al.

(10) Patent No.: US 10,095,151 B2
(45) Date of Patent: Oct. 9, 2018

(54) EXPOSURE DEVICE, IMAGE FORMATION APPARATUS, AND METHOD OF MANUFACTURING EXPOSURE DEVICE

(71) Applicant: Oki Data Corporation, Tokyo (JP)

(72) Inventors: Manabu Imai, Tokyo (JP); Susumu Chihara, Tokyo (JP); Satoshi Fuyuno, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/385,008

(22) Filed: Dec. 20, 2016

(65) Prior Publication Data

US 2017/0184994 A1 Jun. 29, 2017

(30) Foreign Application Priority Data

Dec. 25, 2015 (JP) ..... 2015-253266
Nov. 29, 2016 (JP) ..... 2016-231006

(51) Int. Cl.
*G03G 15/04* (2006.01)
*G03G 21/16* (2006.01)

(52) U.S. Cl.
CPC . *G03G 15/04036* (2013.01); *G03G 15/04054* (2013.01); *G03G 21/1666* (2013.01)

(58) Field of Classification Search
CPC ..... G03G 15/04036; G03G 15/04054; G03G 15/04063; G03G 21/1666; G03G 2215/0409; G03G 2215/0412; G03G 2221/1636
See application file for complete search history.

(56) References Cited

U.S. PATENT DOCUMENTS

2012/0075403 A1* 3/2012 Nagamine ..... B41J 2/45 347/242
2015/0370193 A1* 12/2015 Okazaki ..... G03G 15/04054 347/118

FOREIGN PATENT DOCUMENTS

JP 2009-073041 A 4/2009

* cited by examiner

*Primary Examiner* — David M Gray
*Assistant Examiner* — Laura Roth
(74) *Attorney, Agent, or Firm* — Metrolexis Law Group, PLLC

(57) ABSTRACT

An exposure device according to one or more embodiments may include a board on which light emitting elements are arranged; an optical system disposed opposite to the board; and a support member which supports the board and the optical system. The exposure device may further include a cured body disposed on the support member and including a board contact surface to come into contact with the board.

17 Claims, 25 Drawing Sheets

EXPOSURE DEVICE, IMAGE FORMATION APPARATUS, AND METHOD OF MANUFACTURING EXPOSURE DEVICE

CROSS REFERENCE TO RELATED APPLICATIONS

This application claims priority based on 35 USC 119 from prior Japanese Patent Application No. 2015-253266 filed on Dec. 25, 2015, entitled "EXPOSURE DEVICE, IMAGE FORMATION APPARATUS, AND METHOD OF MANUFACTURING EXPOSURE DEVICE" and prior Japanese Patent Application No. 2016-231006 filed on Nov. 29, 2016, entitled "EXPOSURE DEVICE, IMAGE FORMATION APPARATUS, AND METHOD OF MANUFACTURING EXPOSURE DEVICE", the entire contents of which are incorporated herein by reference.

BACKGROUND OF THE INVENTION

1. Field of the Invention

This disclosure relates to an exposure device, an image formation apparatus, and a method of manufacturing an exposure device.

2. Description of Related Art

An electrophotographic image formation apparatus, such as a printer, a copier, a facsimile machine, and a multifunction machine, is equipped with an exposure device, which forms an electrostatic latent image on a surface of an image carrier (a photoconductor drum) by irradiating the surface with light.

The exposure device includes a board on which light emitting diodes (LEDs) being light emitting elements are arranged, a lens array disposed opposite to the board, and a holder which holds the board and the lens array. The holder includes an opening to which to attach the lens array, and aboard contact surface formed at a predetermined interval from the lens array in an optical axis direction. A distance between the LEDs on the board and the lens array is determined by placing the board on the board contact surface (see Japanese Patent Application Publication No. 2009-73041 (paragraphs 0022 and 0025, and FIG. 1)).

The holder is generally made of an aluminum die-cast body, and the board contact surface is formed by machining. In general, a flatness of the board contact surface is about 20 μm.

SUMMARY OF THE INVENTION

As mentioned above, the conventional exposure device requires a highly accurate surface machining on the aluminum die-cast body and therefore has the problem of an increase in manufacturing cost.

An object of an embodiment of the invention is to reduce a manufacturing cost of an exposure device.

An aspect of the invention is an exposure device that includes: a board on which light emitting elements are arranged; an optical system disposed opposite to the board; a support member which supports the board and the optical system; and a cured body disposed on the support member and including a board contact surface to come into contact with the board, wherein the cured body is formed by curing a deformable material.

According to the aspect of the invention, the cured body provided with the board contact surface is formed by curing the deformable material. Thus, it is possible to reduce a manufacturing cost as compared to the case of machining a die-cast body.

DETAILED DESCRIPTION OF EMBODIMENTS

Figure 1:
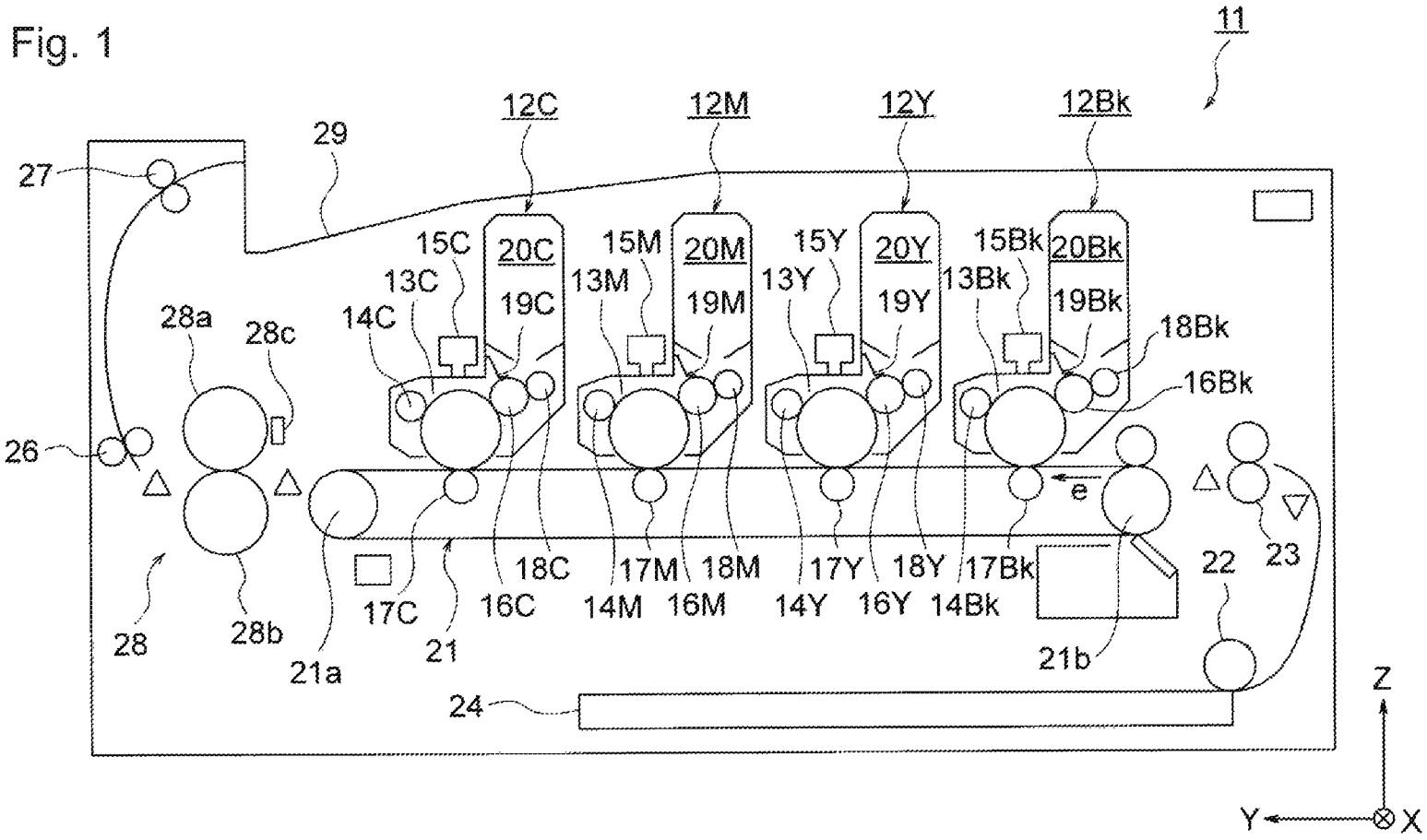
FIG. 1 is a diagram illustrating a basic configuration of an image formation apparatus of a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

First Embodiment

<Configuration of Image Formation Apparatus>

FIG. 1 is a diagram illustrating a basic configuration of image formation apparatus 11 of a first embodiment of the invention. As illustrated in FIG. 1, image formation apparatus 11 includes image formation units (process units) 12Bk, 12Y, 12M, and 12C. Image formation units 12Bk, 12Y, 12M, and 12C form images in black (Bk), yellow (Y), magenta (M), and cyan (C), respectively. Image formation units 12 Bk, 12Y, 12M, and 12C are arranged from an upstream side to a downstream side (from a right side to a left side in this case) along a paper sheet (record medium) conveyance path. Besides paper sheets, OHP sheets, envelopes, copying paper sheets, specialty paper sheets, and the like can be used as the record media.

Image formation units 12Bk, 12Y, 12M, and 12C respectively include: photoconductor drums 13Bk, 13Y, 13M, and 13C serving as electrostatic latent image carriers; charge rollers 14Bk, 14Y, 14M, and 14C serving as charging devices to uniformly charge surfaces of photoconductor drums 13Bk, 13Y, 13M, and 13C; and development rollers 16Bk, 16Y, 16M, and 16C serving as developer carriers to cause toners (developers) in the respective colors to adhere to electrostatic latent images formed on the surfaces of photoconductor drums 13Bk, 13Y, 13M, and 13C and thereby to form toner images (visible images).

Meanwhile, toner supply rollers 18Bk, 18Y, 18M, and 18C serving as developer supply members which supply the toners to development rollers 16Bk, 16Y, 16M, and 16C, and development blades 19Bk, 19Y, 19M, and 19C which control the thicknesses of toner layers to be formed on surfaces of development rollers 16Bk, 16Y, 16M, and 16C are disposed in contact with the development rollers 16Bk, 16Y, 16M, and 16C. In the meantime, toner cartridges 20Bk, 20Y, 20M, and 20C serving as developer containers, which drop and thus supply the toners, are detachably attached to upper parts of toner supply rollers 18Bk, 18Y, 18M, and 18C. Meanwhile, LED heads 15Bk, 15Y, 15M, and 15C serving as exposure devices are disposed above image formation units 12Bk, 12Y, 12M, and 12C and opposite to photoconductor drums 13Bk, 13Y, 13M, and 13C, respectively. LED heads 15Bk, 15Y, 15M, and 15C form the electrostatic latent images by exposing the surfaces of photoconductor drums 13Bk, 13Y, 13M, and 13C to light in accordance with image data on the respective colors.

A transfer unit is arranged below image formation units 12Bk, 12Y, 12M, and 12C. The transfer unit includes: conveyance belt 21 serving as a conveyance member which suctions and moves a paper sheet; driver roller 21*a* which drives conveyance belt 21; tension roller 21*b* which applies tension to conveyance belt 21; and transfer rollers 17Bk, 17Y, 17M, and 17C serving as transfer members and disposed opposite to photoconductor drums 13Bk, 13Y, 13M, and 13C while interposing conveyance belt 21 in-between. Conveyance belt 21 and transfer rollers 17Bk, 17Y, 17M, and 17C charge the paper sheet to the polarity opposite to that of the toners, and thus transfer the toner images in the respective colors formed on photoconductor drums 13Bk, 13Y, 13M, and 13C onto the paper sheet.

Fixation device 28 is disposed on a downstream side (the left in FIG. 1) of photoconductor drums 13Bk, 13Y, 13M, and 13C. Fixation device 28 includes: fixation roller 28*a* and pressure roller 28*b* which fix the toner images, having been transferred onto the paper sheet, further to the paper sheet by using heat and pressure; and temperature sensor 28*c* which detects a surface temperature of fixation roller 28*a*.

A sheet feeder mechanism for supplying paper sheets to the conveyance path is arranged below image formation apparatus 11. The sheet feeder mechanism includes: paper sheet cassette 24 serving as a media container to contain the paper sheets; hopping roller 22 which picks up the paper sheets contained in paper sheet cassette 24 one by one; and registration roller pair 23 that conveys the paper sheets, which are picked up by hopping roller 22, to conveyance belt 21.

Meanwhile, a discharge mechanism for discharging the paper sheets is arranged on the downstream side of fixation device 28 in image formation apparatus 11. The discharge mechanism includes discharge roller pairs 26 and 27 which convey the paper sheets discharged from fixation device 28 and discharge the paper sheets from a discharge port.

In the above-described configuration, an axial direction of each of photoconductor drums 13 in image formation units 12Bk, 12Y, 12M, and 12C is defined as an X direction. Meanwhile, a direction of movement of record medium P when passing through image formation units 12Bk, 12Y, 12M, and 12C is defined as a Y direction (or a +Y direction to be more precise). Further, a direction orthogonal to both the X direction and the Y direction is defined as a Z direction. Here, the Z direction is regarded as a vertical direction and its upward direction is defined as a +Z direction while its downward direction is defined as a −Z direction.

<Configuration of LED Heads>

Next, a description is given of a configuration of LED heads 15Bk, 15Y, 15M, and 15C each serving as the exposure device. LED heads 15Bk, 15Y, 15M, and 15C have the same configuration and are therefore described below collectively as "LED head 15". Likewise, photoconductor drums 13Bk, 13Y, 13M, and 13C have the same configuration and are therefore described collectively as "photoconductor drum 13".

Figure 2:
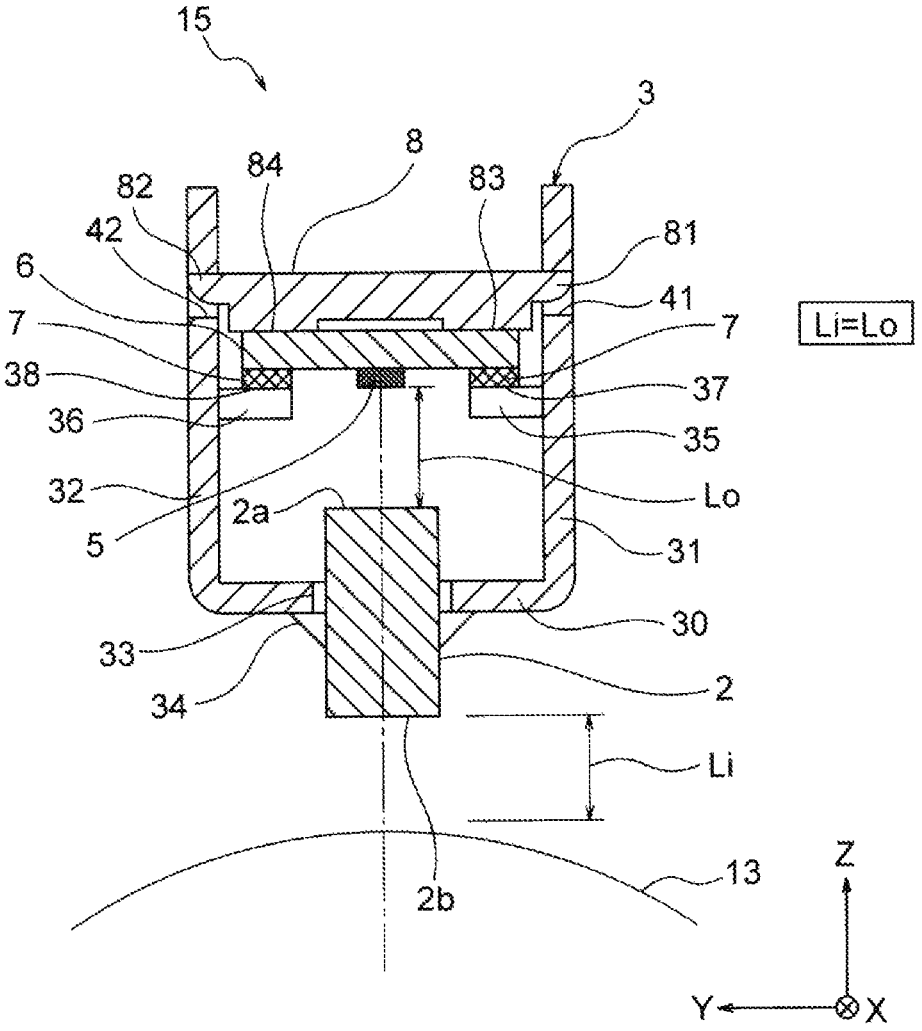
FIG. 2 is a cross-sectional view illustrating an LED head as an exposure device of the first embodiment.

FIG. 2 is a cross-sectional view illustrating LED head 15 of the first embodiment of the invention. As illustrated in FIG. 2, LED head 15 includes: LED array chip 5 provided with LEDs (light emitting elements) disposed opposite to photoconductor drum 13; and board 6 which mounts a not-illustrated driver IC for controlling LED array chip 5. The LEDs of LED head 15 are arranged in a line in the X direction (the axial direction of photoconductor drum 13). In the meantime, board 6 is made of glass epoxy resin, for example.

LED head 15 also includes rod lens array 2 serving as an optical system and disposed opposite to board 6. Rod lens array 2 includes rod lenses (lens elements) which focus light emitted from the respective LEDs of LED array chip 5 on the surface of photoconductor drum 13 into an image. The rod lenses of rod lens array 2 are arranged in a line (or two or more lines) in the X direction while aligning each optical axis direction with the Z direction.

LED head 15 also includes holder 3 serving as a support member which supports board 6 and rod lens array 2. Holder 3 is an elongated member which extends in the X direction, and is formed by performing press work on a sheet metal material, for example. Holder 3 includes a pair of side wall portions 31 and 32 (side plate portions) opposed to each other in the Y direction, and bottom portion 30 (bottom plate portion) opposed to photoconductor drum 13.

Opening 33 (an elongated hole) into which rod lens array 2 is inserted is formed at bottom portion 30 of holder 3. Rod lens array 2 is inserted into opening 33 in a state of aligning the optical axis direction of each rod lens with the Z direction. Rod lens array 2 is fixed to holder 3 while being positioned in the Z direction such that distance Lo between incidence surface 2*a* and LED array chip 5 becomes an optimum distance in light of properties of rod lens array 2. In order to prevent light and foreign substances from entering LED head 15, a gap between opening 33 of holder 3 and rod lens array 2 is sealed with sealant 34.

Hold parts 35 and 36 that hold board 6 from its lower side (the −Z side) are formed on inner sides in the Y direction of side wall portions 31 and 32 of holder 3. Hold parts 35 and 36 are formed by cutting out given portions of side wall portions 31 and 32 and bending the portions inward in the Y direction. Upper surfaces of hold parts 35 and 36 constitute reception surfaces 37 and 38 that are parallel to an XY plane.

Figure 3:
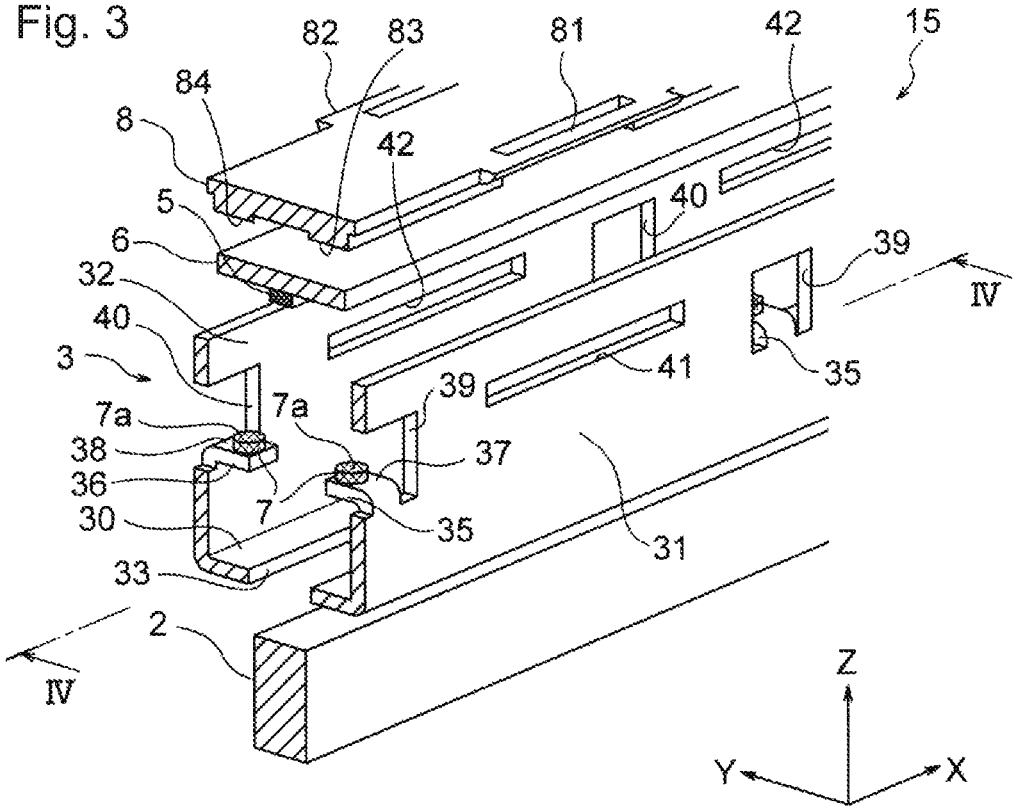
FIG. 3 is an exploded perspective view illustrating the LED head of the first embodiment.
Figure 4:
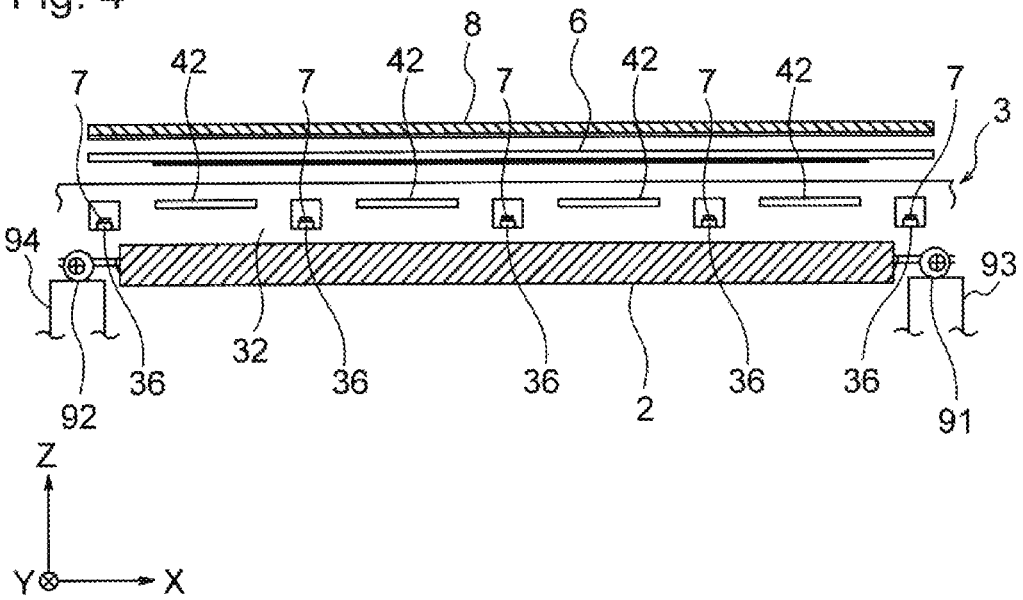
FIG. 4 is a vertical sectional view illustrating the LED head of the first embodiment.

FIG. 3 is an exploded perspective view illustrating the configuration of LED head 15. FIG. 4 is a vertical sectional view at a position indicated with the IV-IV line in FIG. 3 and viewed from a direction of the arrows therein. Multiple hold parts 35 and 36 are disposed at regular intervals in the X direction (the longitudinal direction of holder 3), respectively.

Openings 39 and 40 are formed at portions of side wall portions 31 and 32 where hold parts 35 and 36 are cut out. Moreover, in side wall portion 31, slits 41 serving as engagement holes to be engaged with engagement pieces 81 of press member 8 to be described later are formed between openings 39 that are adjacent to one another in the X direction. Likewise, in side wall portion 32, slits 42 serving as engagement holes to be engaged with engagement pieces 82 of press member 8 are formed between openings 40 that are adjacent to one another in the X direction.

Cured bodies 7 are disposed on reception surfaces 37 and 38 of hold parts 35 and 36 of holder 3, respectively. Cured bodies 7 are formed by curing an acrylic UV (ultraviolet)-curable adhesive, for example. Board 6 is placed on cured bodies 7 in such a way as to aim LED array chip 5 toward rod lens array 2. Board 6 is a substantially rectangular board having a long side in the X direction and a short side in the Y direction. Each cured body 7 has board contact surface 7*a* that comes into contact with a lower surface (a surface on the −Z side) of board 6. Board contact surfaces 7*a* come into contact with the lower surface of board 6 at end portions on two sides in a width direction (the Y direction) of board 6. Note that UV-curable adhesive is an adhesive made of a resin to be cured by ultraviolet irradiation. The acrylic UV-curable adhesive is used in this embodiment.

Press member 8 to press board 6 against cured bodies 7 is arranged above board 6. Press member 8 is a plate-like member made of a plastic and into a substantially rectangular shape having a long side in the X direction and a short side in the Y direction.

Contact surfaces 83 and 84 that come into contact with an upper surface (a surface on the +Z side) of board 6 are formed on a lower surface of press member 8. Meanwhile, engagement pieces 81 and 82 serving as engagement portions to be engaged with slits 41 and 42 of side wall portions 31 and 32 are formed in a projecting manner on two long sides of press member 8.

Engagement pieces 81 and 82 of press member 8 are depicted as protruding horizontally (in parallel with the XY plane) in FIG. 3. However, in reality, engagement pieces 81 and 82 protrude in such a way as to be warped slightly upward as illustrated in FIG. 7B as described later. When engagement pieces 81 and 82 are brought into engagement with slits 41 and 42, engagement pieces 81 and 82 are elastically deformed, and press member 8 presses board 6 against board contact surfaces 7*a* of cured bodies 7 with an elastic force therefrom. Thus, board 6 is held in the state of being pressed against cured bodies 7 by press member 8.

Here, in order to collect the light precisely on the surface of photoconductor drum 13, distance Li from emission surface 2*b* of rod lens array 2 to the surface of photoconductor drum 13 needs to be adjusted such that distance Lo from the surface of LED array chip 5 to incidence surface 2*a* of rod lens array 2 becomes equal to distance Li.

To this end, as illustrated in FIG. 4, eccentric cams 91 and 92 serving as an adjustment mechanism are arranged near two ends in the X direction of holder 3. Eccentric cams 91 and 92 come into contact with spacers 93 and 94 that are disposed in slidable contact with portions of the surface of photoconductor drum 13 which are located near the two ends in the X direction. Moreover, a not-illustrated coil spring (a biasing member) is provided above press member 8, and biases LED head 15 toward photoconductor drum 13. By rotating and adjusting eccentric cams 91 and 92, it is possible to adjust distance Li and distance Lo equal to each other (Li=Lo) entirely in the longitudinal direction (the X direction) of holder 3.

<Operation of Image Formation Apparatus>

Next, an image formation operation by image formation apparatus 11 is described with reference to FIGS. 1 and 2. When the image formation operation is started, the paper sheets in paper sheet cassette 24 are picked up one by one by hopping roller 22, and are conveyed to conveyance belt 21 by registration roller pair 23. Conveyance belt 21 suctions and holds the paper sheets and moves in a direction indicated by arrow e.

Meanwhile, in image formation units 12Bk, 12Y, 12M, and 12C, the surfaces of photoconductor drums 13Bk, 13Y, 13M, and 13C are uniformly charged by charge rollers 14Bk, 14Y, 14M, and 14C, respectively.

Furthermore, each of LED heads 15Bk, 15Y, 15M, and 15C emits the light in accordance with the image data on the corresponding color. As illustrated in FIG. 2, in each LED head 15, the light emitted from LED array chip 5 is made incident on incidence surface 2*a* of rod lens array 2, and is further emitted from emission surface 2*b* of rod lens array 2 and focused on the surface of photoconductor drum 13. Thus, the electrostatic latent image is formed on a photosensitive layer on the surface of photoconductor drum 13.

Back to FIG. 1, the electrostatic latent images formed on the respective surfaces of photoconductor drums 13Bk, 13Y, 13M, and 13C are developed into the toner images by development rollers 16Bk, 16Y, 16M, and 16C. Moreover, with the movement of the conveyance belt 21, each paper sheet is passed through spaces between image formation units 12Bk, 12Y, 12M, and 12C and transfer rollers 17Bk, 17Y, 17M, and 17C. On this occasion, the toner images formed on the respective surfaces of photoconductor drums 13Bk, 13Y, 13M, and 13C are transferred in sequence to the paper sheet.

The paper sheet to which the toner images are transferred is sent to the fixation device 28 and is heated and pressed by fixation roller 28*a* and pressure roller 28*b*, whereby the toner images are fused, pressure-bonded, and thus fixed to the paper sheet to form a color image. The paper sheet provided with the color image is discharged out of image formation apparatus 11 by discharge roller pairs 26 and 27, and is loaded on stacker unit 29 provided on an upper part of image formation apparatus 11.

<Method of Manufacturing LED Head>

Next, a description is given of a method of manufacturing LED head 15 as the exposure device. First, holder 3 having the shape as illustrated in FIGS. 2 and 3 is formed by performing the press work on the sheet metal material.

Figure 5:
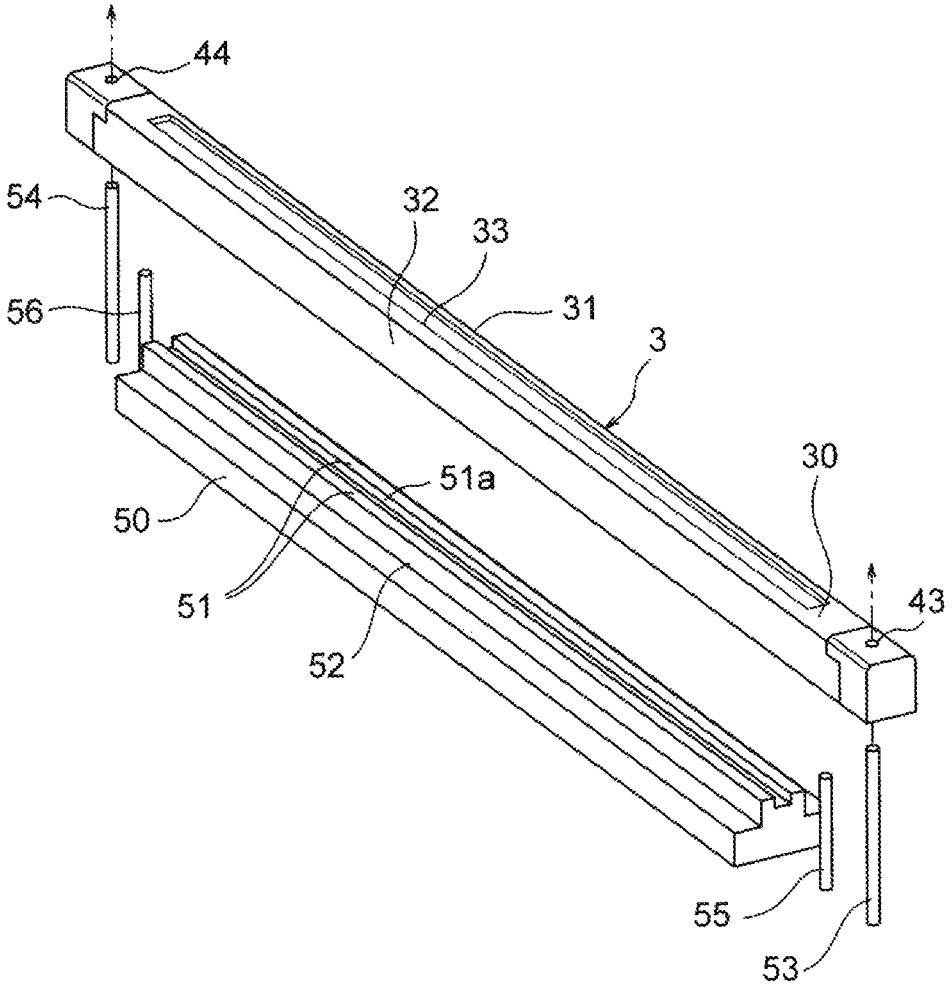
FIG. 5 is a schematic diagram for explaining a jig to form a cured body of the LED head of the first embodiment.

Then, cured bodies 7 are formed on hold parts 35 and 36 (FIG. 2) of holder 3, respectively. FIG. 5 is a schematic diagram for explaining jig 50 to form cured bodies 7 on holder 3.

Jig 50 is a member that is made long in one direction. Jig 50 includes reference surface 51 which is flat and parallel to a horizontal plane. A flatness of reference surface 51 is set to about 10 μm, for example. Reference surface 51 undergoes a coating of, for example, a resin (to be more precise, a silicone resin) so as not to cause cured body 7 to adhere thereto.

Insertion portion 52 having a convex shape is formed at the center in the width direction of jig 50. Insertion portion 52 is a portion to be inserted to an inner side between side wall portions 31 and 32 of holder 3. Reference surface 51 mentioned above is formed on an upper surface of insertion portion 52. While groove 51*a* is formed at the center in the width direction of reference surface 51 in the example illustrated in FIG. 5, groove 51*a* does not always have to be formed.

A pair of guide pins 53 and 54 (guide members) are provided as positions to sandwich jig 50 from two sides in the longitudinal direction. Guide pins 53 and 54 extend in the vertical direction, and come into engagement with engagement holes 43 and 44 formed near two ends in the longitudinal direction of holder 3. Thus, guide pins 53 and 54 guide holder 3 in such a direction (the vertical direction) to approach and recede from jig 50.

In addition, stopper pins 55 and 56 (control members) are provided between jig 50 and guide pins 53 and 54. Stopper pins 55 and 56 extend parallel to guide pins 53 and 54, but have a shorter length than that of guide pins 53 and 54. Stopper pins 55 and 56 are designed to come into contact with an inner surface of bottom portion 30 of holder 3, and to control the position of holder 3 in the vertical direction.

Figure 6A:
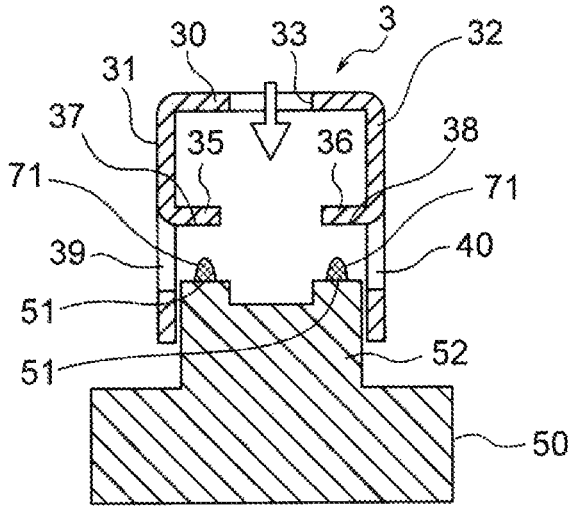
FIGS. 6A to 6C are schematic diagrams for explaining a method of forming the cured body of the LED head of the first embodiment.
Figure 6B:
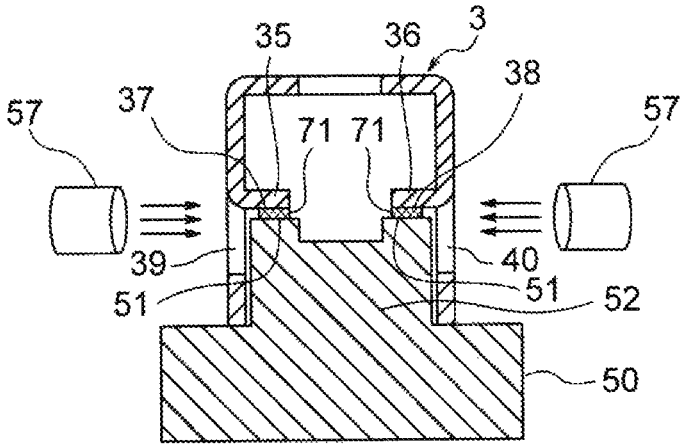
Figure 6C:
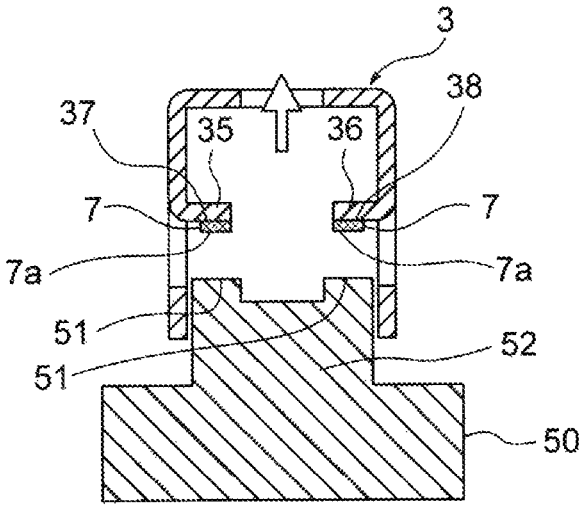

FIGS. 6A to 6C are schematic diagrams for explaining a method of forming cured bodies 7 on holder 3. First, as illustrated in FIG. 6A, curable material 71 is applied to (dripped on) locations on reference surface 51 of jig 50 which correspond to hold parts 35 and 36 of holder 3.

Here, a material (a pre-cured material) to be formed into cured bodies 7 by undergoing certain processing such as UV irradiation is referred to as the "curable material". Curable material 71 is the acrylic UV-curable adhesive, for example, but is not limited to the foregoing. Curable material 71 is not cured yet at the point applied to hold parts 35 and 36. At this point, curable material 71 has a certain viscosity and is deformable. Moreover, curable material 71 at this stage has a thickness (a dimension in the vertical direction) of 1.0 mm, for example.

Next, holder 3 is retained in such a way as to direct bottom portion 30 upward, and is located above jig 50. Then, holder 3 is moved down along guide pins 53 and 54 (FIG. 5).

As illustrated in FIG. 6B, when holder 3 is moved down, hold parts 35 and 36 of holder 3 come into contact with curable material 71 and press curable material 71. Then, holder 3 is further moved down to come into contact with stopper pins 55 and 56 (FIG. 5), and the downward movement of holder 3 is thus stopped. In this state, curable material 71 is pressed to a thickness of about 0.5 mm, for example.

Subsequently, curable material 71 is subjected to UV irradiation by using UV irradiators 57, and curable material 71 is thus cured. Here, UV irradiators 57 irradiate curable material 71 with ultraviolet rays through openings 39 and 40 of side wall portions 31 and 32 of holder 3 mentioned above. In this way, curable material 71 is cured and formed into cured bodies 7 mentioned above. Cured bodies 7 are in the state of adhering (i.e., being attached) to reception surfaces 37 and 38 of hold parts 35 and 36.

Then, as illustrated in FIG. 6C, holder 3 is pulled up along guide pins 53 and 54. Reference surface 51 of jig 50 is provided with a resin coating so as to avoid any adhesion of cured bodies 7. Accordingly, cured bodies 7 in the state of adhering to hold parts 35 and 36 are detached from reference surface 51. Hence, the surfaces of cured bodies 7 previously in contact with reference surface 51 constitute board contact surfaces 7*a*.

Figure 7A:
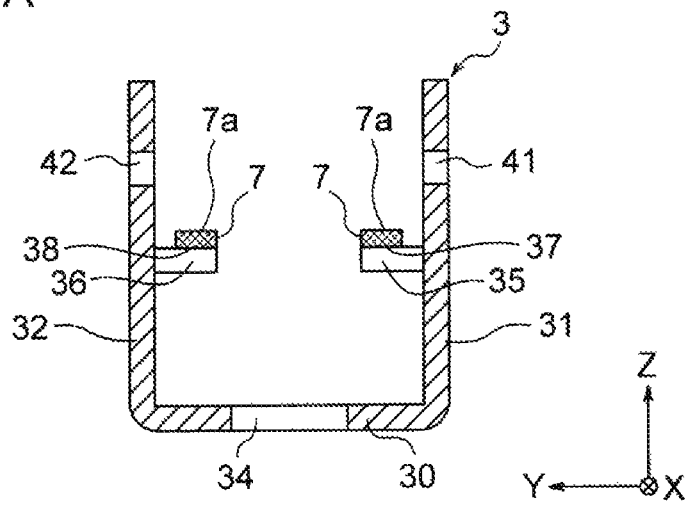
FIGS. 7A and 7B are schematic diagrams for explaining a method of forming the LED head of the first embodiment.
Figure 7B:
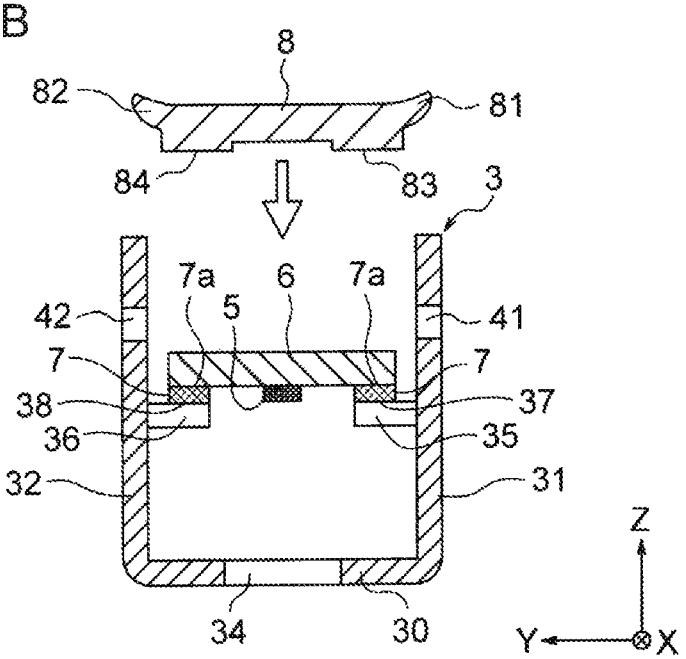

By detaching holder 3 from jig 50, holder 3 on which cured bodies 7 with board contact surfaces 7*a* are arranged is obtained as illustrated in FIG. 7A.

Thereafter, holder 3 is retained in such a way as to direct bottom portion 30 downward, and board 6 is placed on board contact surfaces 7*a* of cured bodies 7 as illustrated in FIG. 7B. Subsequently, press member 8 is attached onto board 6. At this time, engagement pieces 81 and 82 of press member 8 are elastically deformed and brought into engagement with slits 41 and 42 of holder 3. Meanwhile, contact surfaces 83 and 84 on the lower surface of press member 8 come into contact with the upper surface of board 6. Press member 8 presses board 6 against board contact surfaces 7*a* of cured bodies 7 by using the elastic force of engagement pieces 81 and 82. Thus, holder 3, board 6, and press member 8 are assembled together.

Next, rod lens array 2 is attached to opening 33 at bottom portion 30 of holder 3. Rod lens array 2 is positioned in terms of the Z direction such that its distance from LED array chip 5 becomes equal to distance Lo (FIG. 2), and is then fixed to opening 33 with an adhesive, for example. In the meantime, the gap between opening 33 and rod lens array 2 is sealed with sealant 34. Here, rod lens array 2 may be attached to holder 3 prior to the formation of cured bodies 7 (FIGS. 6A to 6C).

In this way, LED head 15 (the exposure device) in which holder 3, rod lens array 2, board 6, and press member 8 are assembled together is finished as illustrated in FIG. 2.

<Operation and Effect>

Hold parts 35 and 36 of holder 3 are formed by bending the given portions of side wall portions 31 and 32. For this reason, the positions in the Z direction of reception surfaces 37 and 38, being the surfaces of hold parts 35 and 36, vary in a range of about 0.25 mm. In other words, the positions in the Z direction of reception surfaces 37 (38) provided to holder 3 are likely to vary in the range of about 0.25 mm.

Nevertheless, in this embodiment, curable material 71 on reference surface 51 having the flatness of about 10 μm is pressed with hold parts 35 and 36 of holder 3, and curable material 71 in that state is cured into cured bodies 7 as described with reference to FIG. 6B. Then, the surfaces previously in contact with reference surface 51 of cured bodies 7 constitute board contact surfaces 7*a*. As a consequence, the flatness as a whole of board contact surfaces 7*a* of all cured bodies 7 formed on multiple positions becomes about 10 μm, which is equal to the flatness of reference surface 51 of jig 50. Note that in this disclosure the flatness of board contact surface 7*a* or reference surface 51 is measured by detecting heights of all measuring points on board contact surface 7*a* or reference surface 51 with a laser length measuring machine and obtaining a difference between the detected maximum height and the detected minimum height thereof as the flatness.

In a general exposure device, the holder is made of an aluminum die-cast body, and the board contact surface is formed by finish machining at a flatness of about 20 μm. Accordingly, the manufacturing process is complicated and a manufacturing cost tends to increase.

On the other hand, in this embodiment, curable material 71 is applied to flat reference surface 51, and then curable material 71 is cured in the state of being pressed with hold parts 35 and 36 of holder 3. Accordingly, cured bodies 7 having flat board contact surfaces 7*a* can be formed without performing the complicated finish machining. Thus, it is possible to simplify the manufacturing process of LED head 15 and to reduce the manufacturing cost thereof.

The surface flatness as a whole of cured bodies 7 at the multiple positions is most preferably set to about 10 μm. However, board 6 can be positioned at a high accuracy by setting the flatness equal to or below 100 μm.

Meanwhile, since cured bodies 7 made of a resin are interposed between board 6 and holder 3, board 6 is electrically insulated from holder 3. For this reason, it is not necessary to provide board 6 with a resist layer for securing insulation.

Moreover, machining is easy when holder 3 is made of the sheet metal material. In addition, since holder 3 is made of the metal material, it is possible to suppress deformation after forming the board contact surfaces thereon. In addition, it is possible to reduce the material cost and further to reduce the manufacturing cost as compared to the case of using the aluminum die-cast body as holder 3.

Meanwhile, hold parts 35 and 36 are formed by bending the given portions of side wall portions 31 and 32 of holder 3, and cured bodies 7 are provided on hold parts 35 and 36. In this way, LED head 15 (the exposure device) can be manufactured by using a fewer number of components.

In addition, by using the resin to be cured by irradiation of ultraviolet rays as curable material 71, cured bodies 7 can be formed easily by performing the UV irradiation. Thus, it is possible to further simplify the manufacturing process of LED head 15.

First Modified Example

Figure 8:
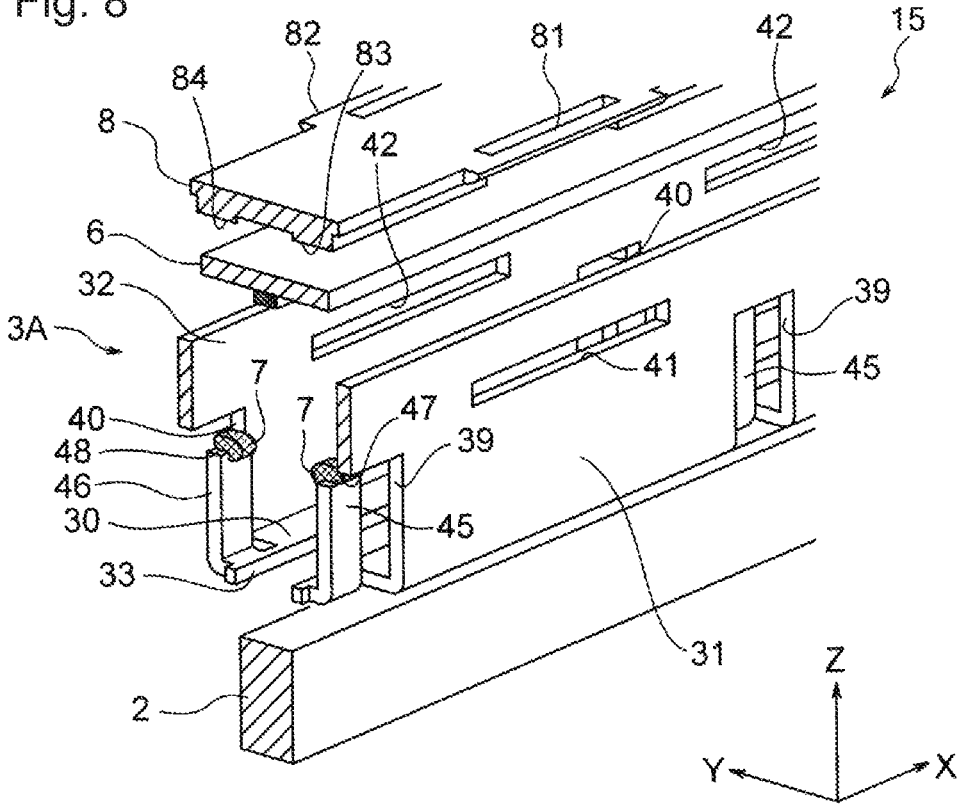
FIG. 8 is an exploded perspective view illustrating an LED head of a first modified example of the first embodiment.
Figure 9:
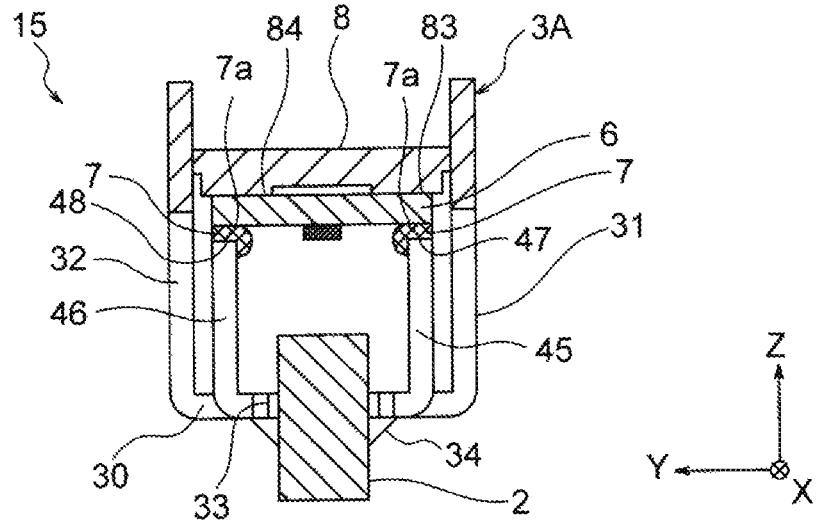
FIG. 9 is a cross-sectional view illustrating the LED head of the first modified example of the first embodiment.

FIG. 8 is an exploded perspective view illustrating LED head 15 (the exposure device) of a first modified example of the first embodiment. FIG. 9 is a cross-sectional view of LED head 15 illustrated in FIG. 8. In LED head 15 of the first modified example, a configuration of holder 3A is different from that of holder 3 (FIG. 2) described above.

Specifically, in the above-described first embodiment, hold parts 35 and 36 are formed on side wall portions 31 and 32 of holder 3. On the other hand, in this first modified example, hold parts 45 and 46 are formed on bottom portion 30 of holder 3A.

That is to say, hold parts 45 and 46 that extend upward from bottom portion 30 (or to be more precise, from two sides in the Y direction of opening 33) are formed by cutting out a portion of holder 3A extending from bottom portion 30 to side wall portion 31 and a portion thereof extending from bottom portion 30 to side wall portion 32, respectively, and then bending the cutout portions upward.

As illustrated in FIG. 9, upper end surfaces of hold parts 45 and 46 constitute reception surfaces 47 and 48. Cured bodies 7 are formed on reception surfaces 47 and 48 of hold parts 45 and 46, respectively. Upper surfaces of cured bodies 7 constitute flat board contact surfaces 7*a* that come into contact with board 6.

When cured bodies 7 are formed, curable material 71 (see FIG. 6A) is applied to reference surface 51 of jig 50 (FIG. 5), then curable material 71 is pressed with hold parts 45 and 46 of holder 3A, and curable material 71 is cured by the UV irradiation and is formed into cured bodies 7. Attachment of board 6, press member 8, and rod lens array 2 to holder 3A is the same as described in the first embodiment.

In this modified example as well, curable material 71 on reference surface 51 is pressed with hold parts 45 and 46 of holder 3A, and curable material 71 in this state is cured and formed into cured bodies 7. Accordingly, when holder 3A is detached from jig 50, the surfaces of cured bodies 7 previously in contact with reference surface 51 constitute flat board contact surfaces 7*a*. As described above, cured bodies 7 having flat board contact surfaces 7*a* can be formed by using this simple method. Thus, it is possible to simplify the manufacturing process of LED head 15 and to reduce the manufacturing cost thereof.

Second Modified Example

Figure 10:
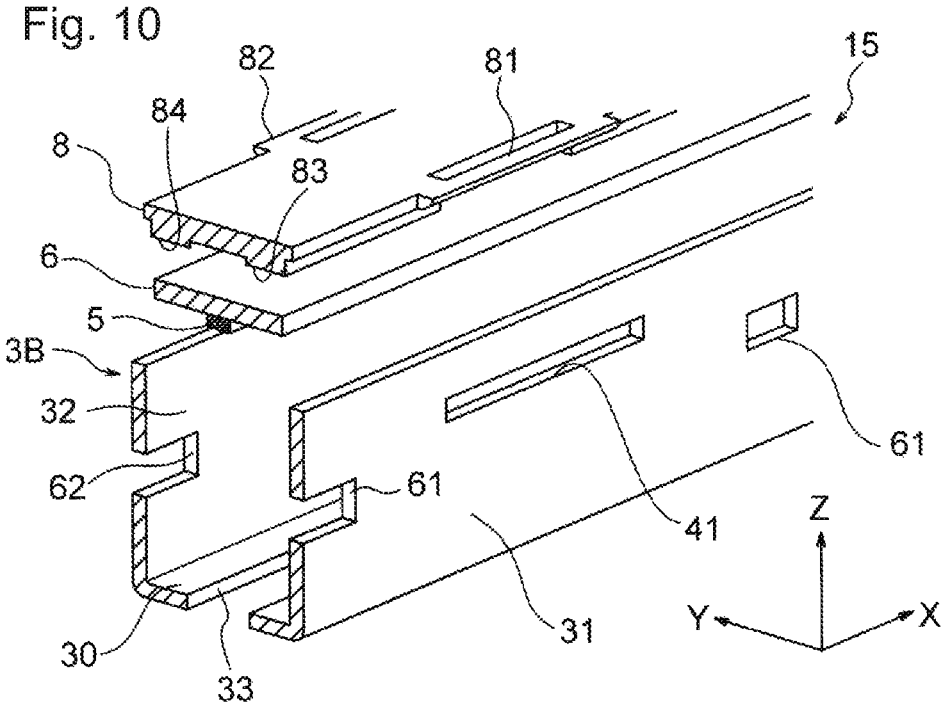
FIG. 10 is an exploded perspective view illustrating an LED head of a second modified example of the first embodiment.
Figure 11:
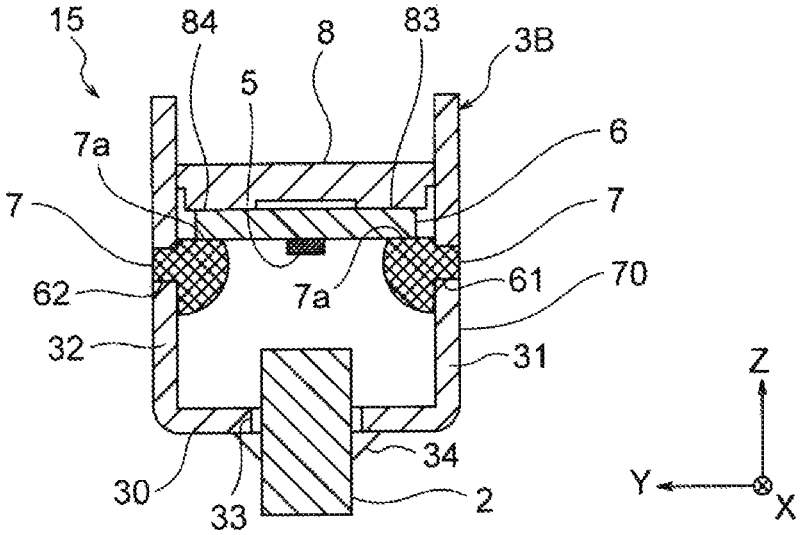
FIG. 11 is a cross-sectional view illustrating the LED head of the second modified example of the first embodiment.

FIG. 10 is an exploded perspective view illustrating LED head 15 (the exposure device) of a second modified example of the first embodiment. FIG. 11 is a cross-sectional view of LED head 15 illustrated in FIG. 10. In LED head 15 of the second modified example, a configuration of holder 3B is different from that of holder 3 (FIG. 2) described above.

Specifically, as illustrated in FIG. 10, holder 3B of the second modified example does not include hold parts 35 and 36 illustrated in FIG. 2 or hold parts 45 and 46 illustrated in FIG. 8. Instead, as illustrated in FIG. 11, cured bodies 7 are formed in regions from openings 61 and 62 provided in side wall portions 31 and 32 of holder 3B to inner surfaces of side wall portions 31 and 32.

Openings 61 and 62 are formed slightly below positions in the Z direction of side wall portions 31 and 32 to which board 6 is to be attached. Cured bodies 7 are provided in such a way as to protrude from openings 61 and 62 to the inner surfaces of side wall portions 31 and 32. Upper surfaces of cured bodies 7 constitute flat board contact surfaces 7*a*.

When cured bodies 7 are formed, holder 3B is attached to jig 50 (FIG. 5). Then, in this state, curable material 71 is injected from openings 61 and 62 of holder 3B. Curable material 71 is pressed by its own weight onto reference surface 51 of jig 50. Further, curable material 71 is cured by the UV irradiation through openings 61 and 62, and is formed into cured bodies 7. Attachment of board 6, press member 8, and rod lens array 2 to holder 3B is the same as described in the first embodiment.

In this modified example as well, curable material 71 injected from openings 61 and 62 of holder 3B is pressed against reference surface 51, and curable material 71 in this state is cured and formed into cured bodies 7. Accordingly, when holder 3B is detached from jig 50, the surfaces of cured bodies 7 previously in contact with reference surface 51 constitute flat board contact surfaces 7*a*. As described above, cured bodies 7 having flat board contact surfaces 7*a* can be formed by using this simple method. Thus, it is possible to simplify the manufacturing process of LED head 15 and to reduce the manufacturing cost thereof.

Second Embodiment

Next, a second embodiment of the invention is described. In the above-described first embodiment, curable material 71 on reference surface 51 of jig 50 is pressed with hold parts 35 and 36 of holder 3, and curable material 71 in this state is cured. In this case, when the area of each board contact surface 7*a* is increased, the size of board 6 also needs to be increased so as not to bring board contact surface 7*a* into contact with a bonding pad and the like on board 6. An object of the second embodiment is to limit the area of board contact surface 7*a*.

The configuration of LED head 15 of the second embodiment is the same as that of the first embodiment except for the shape of each cured body 72.

Figure 12A:
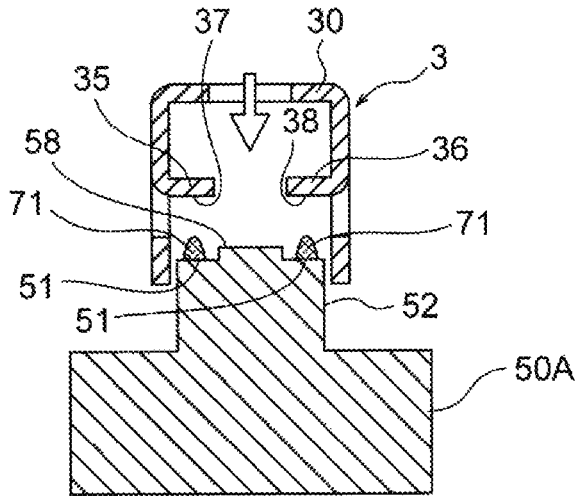
FIGS. 12A to 12C are schematic diagrams for explaining a method of forming a cured body of an LED head of a second embodiment.
Figure 12B:
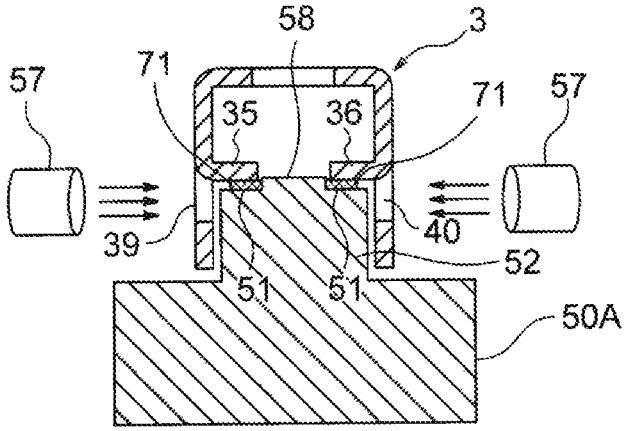
Figure 12C:
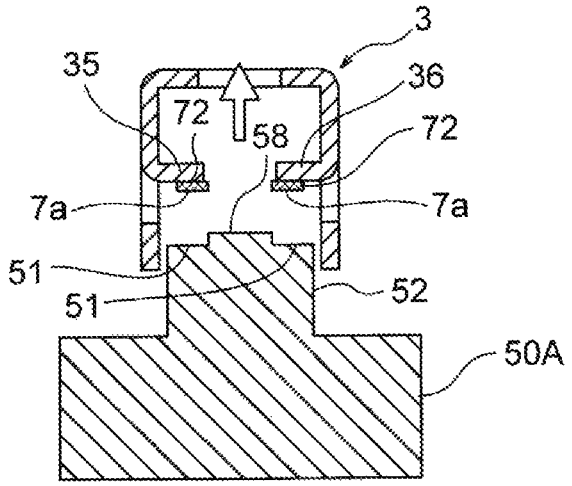

FIGS. 12A to 12C are schematic diagrams for explaining a method of forming cured bodies 72 of the second embodiment. Jig 50A used in the second embodiment is prepared by adding wall portion 58 (a convex portion) to an upper surface of jig 50 described in the first embodiment. Wall portion 58 is formed at the center in the width direction of an upper surface of jig 50A. On the upper surface of jig 50A, reference surfaces 51 are formed on two sides in the width direction of wall portion 58.

First, as illustrated in FIG. 12A, curable material 71 is applied to locations on reference surfaces 51 of jig 50A corresponding to hold parts 35 and 36 of holder 3. Next, as described also in the first embodiment, holder 3 is retained in such a way as to direct bottom portion 30 upward, and is located above jig 50A. Then, holder 3 is moved down along guide pins 53 and 54 (FIG. 5).

As illustrated in FIG. 12B, when holder 3 is moved down, hold parts 35 and 36 of holder 3 press curable material 71 on reference surfaces 51. Pressed curable material 71 tries to spread isotropically on reference surfaces 51 but its spread inward in the width direction of jig 50A is restricted by coming into contact with wall portion 58.

Then, holder 3 comes into contact with stopper pins 55 and 56 (FIG. 5), and the downward movement of holder 3 is thus stopped. Subsequently, curable material 71 is irradiated with ultraviolet rays from UV irradiators 57. Thus, curable material 71 is cured and formed into cured bodies 72.

Thereafter, holder 3 is pulled up as illustrated in FIG. 12C. Reference surface 51 and wall portion 58 of jig 50A are provided with a resin coating so as to avoid an adhesion of the cured bodies 72. Accordingly, cured bodies 72 in the state of adhering to hold parts 35 and 36 are detached from reference surface 51. Hence, the surfaces of cured bodies 72 previously in contact with reference surface 51 constitute board contact surfaces 7*a*.

Attachment of board 6, press member 8, and rod lens array 2 to holder 3 is the same as described in the first embodiment.

As described above, when curable material 71 is pressed with hold parts 35 and 36 of holder 3 and is caused to spread, its spread inward in the width direction of jig 50A is restricted by wall portion 58 (the convex portion). For this reason, each cured body 72 does not spread to a portion opposed to the central part in the width direction of board 6.

In other words, while a bonding pad and the like to be connected to LED array chip 5 are formed at the central part in the width direction of board 6, board contact surface 7*a* does not spread to the position to come into contact with the bonding pad and the like. Accordingly, the width of board 6 can be reduced without causing a contact between board contact surface 7*a* with the bonding pad and the like on board 6. As a consequence, it is possible to reduce the width of LED head 15.

Figure 13A:
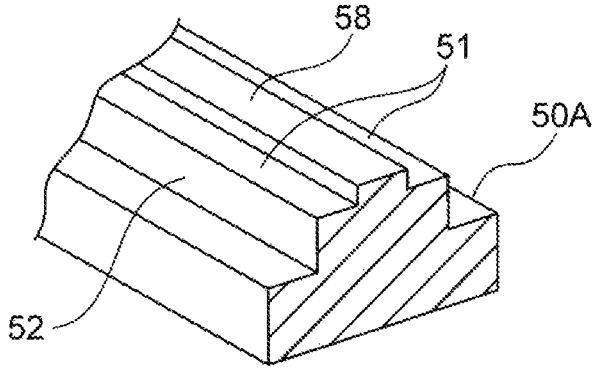
FIG. 13A is a schematic diagram illustrating an example of a jig used in the second embodiment.

Now, a description is given of the shape of cured body 72 formed in accordance with the above-described method. Here, as illustrated in FIG. 13A, wall portion 58 of jig 50A is assumed to be a convex beam that extends in the longitudinal direction of jig 50A. In this case, although curable material 71 tries to spread isotropically on reference surface 51, a portion of curable material 71 that comes into contact with wall portion 58 is formed into a flat surface.

Figure 13B:
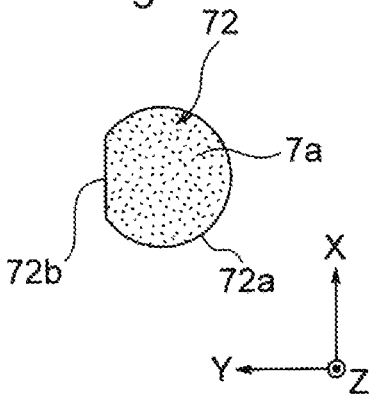
FIG. 13B is a schematic diagram illustrating an example of a planar shape of the cured body.
Figure 13C:
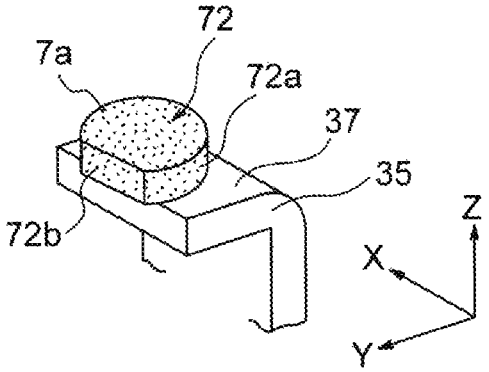
FIG. 13C is a schematic diagram illustrating an example of a three-dimensional shape of the cured body.

As a consequence, as illustrated in FIG. 13B, cured body 72 is formed into such a shape that a substantially circular shape is partially cut away along a straight line when viewed from above. Meanwhile, as illustrated in FIG. 13C, cured body 72 is formed into such a three-dimensional shape that includes outer peripheral surface 72*a* being a substantially cylindrical surface, and flat surface 72*b*.

Figure 14A:
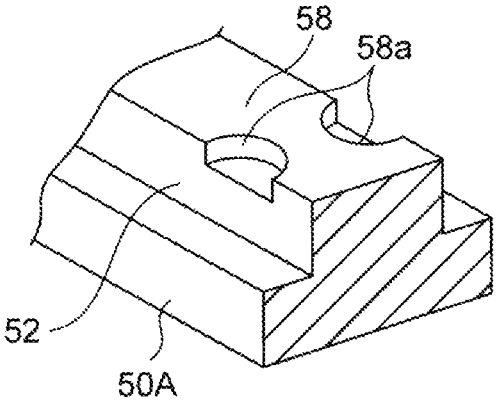
FIG. 14A is a schematic diagram illustrating another example of the jig used in the second embodiment.
Figure 14B:
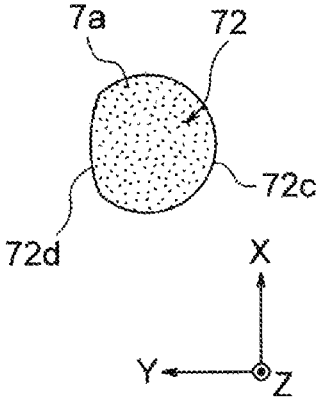
FIG. 14B is a schematic diagram illustrating another example of a planar shape of the cured body.

In the meantime, as illustrated in FIG. 14A, when wall portion 58 has such a concave shape to surround each region where curable material 71 is to be applied, cured body 72 includes outer peripheral surface 72*c* on the outside in the width direction (the Y direction) of holder 3, and outer peripheral surface 72*d* on the inside in the width direction thereof. While outer peripheral surface 72*c* is an outer peripheral surface formed by the isotropic spread of curable material 71, outer peripheral surface 72*d* is an outer peripheral surface formed as a result of curable material 71 coming into contact with wall portion 58. Accordingly, two outer peripheral surfaces 72*c* and 72*d* have curved surfaces that are different from each other.

As described above, in the second embodiment of the invention, cured body 72 has the outer peripheral surface subjected to a restriction of its spread toward a predetermined region (to be more precise, toward the center in the width direction of board 6). Accordingly, the width of board 6 can be reduced while avoiding contact of board contact surface 7*a* with the bonding pad and the like on board 6. This makes it possible to reduce the width of LED head 15. In other words, the second embodiment can contribute to a reduction in the size of LED head 15 in addition to the effects described in the first embodiment.

Note that the second embodiment may also be applied to the respective modified examples (FIGS. 8 to 11) of the first embodiment.

Third Embodiment

Next, a third embodiment of the invention is described. In the above-described second embodiment, the area of board contact surface 7*a* is limited by using wall portion 58 provided to jig 50A. On the other hand, in the third embodiment, the area of board contact surface 7*a* is limited by using a groove provided in each of hold parts 63 and 64.

The configuration of LED head 15 of the third embodiment is the same as that of the first embodiment except for hold parts 63 and 64, and the shape of each cured body 74.

Figure 15:
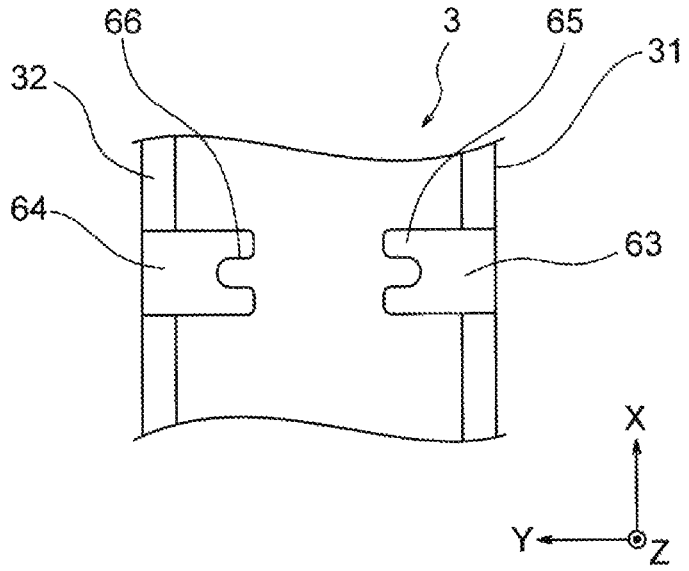
FIG. 15 is a plan view illustrating hold parts of a holder for an LED head of a third embodiment.

FIG. 15 is a diagram illustrating hold parts 63 and 64 of holder 3 of LED head 15 of the third embodiment. Hold parts 63 and 64 provided to holder 3, which is formed by performing press work on a sheet metal material, includes groove portions 65 and 66 provided at end portions on the inner sides in the width direction (the Y direction) of holder 3. Here, groove portions 65 and 66 are each formed as a U-shaped groove having a U-shape. However, groove portions 65 and 66 are not limited to the U-shaped grooves but may have a V-shape or a rectangular shape, for example.

Hold parts 63 and 64 of the third embodiment are formed the same as hold parts 35 and 36 of the first embodiment except for the provision of groove portions 65 and 66. As with hold parts 35 and 36 of the first embodiment, multiple hold parts 63 and 64 are disposed in the longitudinal direction (the X direction) of holder 3, respectively.

Figure 16A:
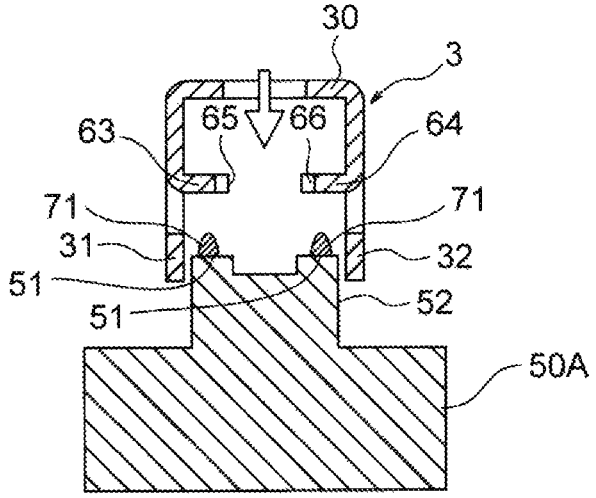
FIGS. 16A to 16C are schematic diagrams for explaining a method of forming a cured body of the LED head of the third embodiment.
Figure 16B:
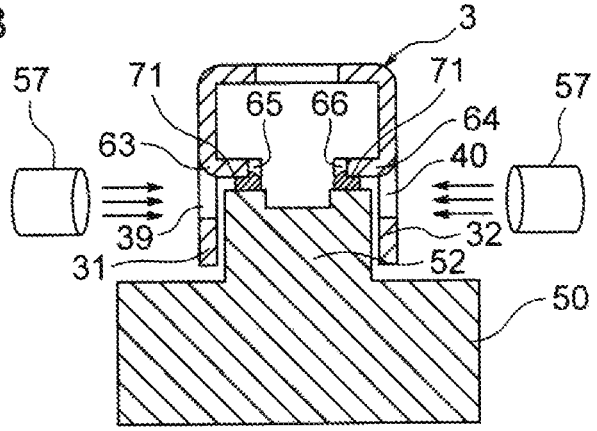
Figure 16C:
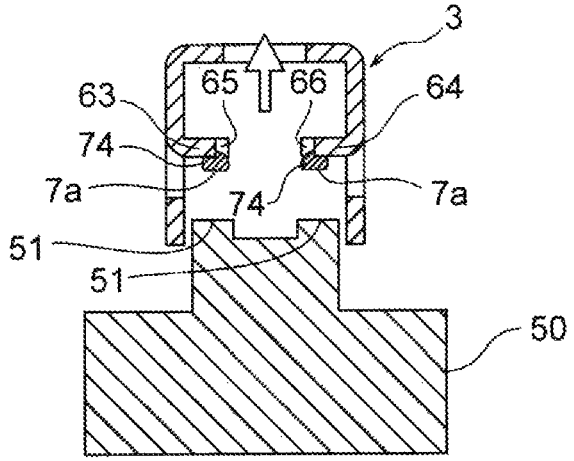

FIGS. 16A to 16C are schematic diagrams for explaining a method of forming cured bodies 74 of the third embodiment. Jig described in the first embodiment is used in the third embodiment.

First, as illustrated in FIG. 16A, curable material 71 is applied to locations on reference surface 51 of jig 50 corresponding to hold parts 63 and 64 of holder 3. Next, as described also in the first embodiment, holder 3 is retained in such a way as to direct bottom portion 30 upward, and is located above jig 50. Then, holder 3 is moved down along guide pins 53 and 54 (FIG. 5).

As illustrated in FIG. 16B, when holder 3 is moved down, hold parts 63 and 64 of holder 3 press curable material 71 on reference surface 51. While pressed, curable material 71 spreads on reference surface 51 and portions of curable material 71 enter groove portions 65 and 66 of hold parts 63 and 64. Thus, the spread of curable material 71 inward in the width direction of jig 50 is restricted.

Then, holder 3 comes into contact with stopper pins 55 and 56 (FIG. 5), and the downward movement of holder 3 is thus stopped. Subsequently, curable material 71 is irradiated with ultraviolet rays from UV irradiators 57. Thus, curable material 71 is cured and formed into cured bodies 74.

Thereafter, holder 3 is pulled up as illustrated in FIG. 16C. Reference surface 51 of jig 50 is provided with a resin coating so as to avoid any adhesion of cured bodies 74. Accordingly, cured bodies 74 in the state of adhering to hold parts 63 and 64 are detached from reference surface 51. Hence, the surfaces of cured bodies 74 previously in contact with reference surface 51 constitute board contact surfaces 7*a*.

The attachment of board 6, press member 8, and rod lens array 2 to holder 3 is the same as described in the first embodiment.

Figure 17A:
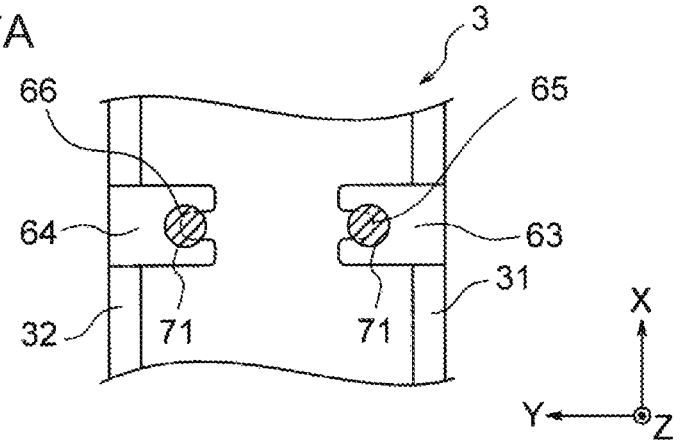
FIG. 17A is a schematic diagram illustrating a relation between the hold parts and a curable material and FIG. 17B is a schematic diagram illustrating a relation between the hold parts and a cured body of the third embodiment.
Figure 17B:
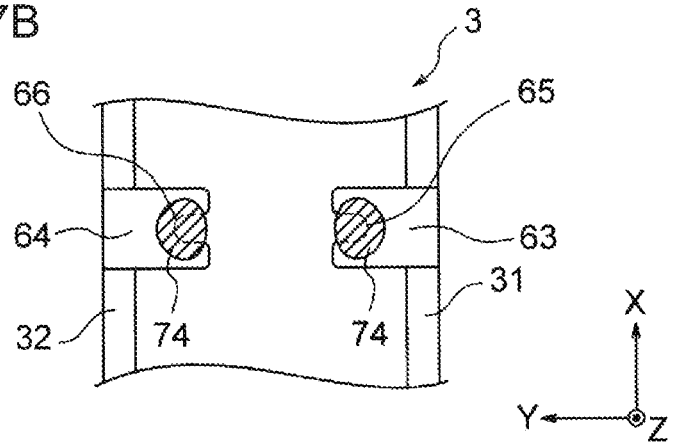

FIG. 17A is a schematic diagram illustrating curable material 71 applied to reference surface 51, and hold parts 63 and 64 in a superimposed manner. FIG. 17B is a schematic diagram illustrating cured bodies 74 after being pressed by hold parts 63 and 64 and cured, and hold parts 63 and 64 in a superimposed manner.

As is clear from FIGS. 17A and 17B, while curable material 71 spreads by being pressed by hold parts 63 and 64, certain portions of curable material 71 enter groove portions 65 and 66 of hold parts 63 and 64. Thus, the spread of curable material 71 is restricted.

In particular, since groove portions 65 and 66 are formed on the inner sides in the Y direction of hold parts 63 and 64, the spread of curable material 71 inward in the Y direction is restricted. Accordingly, board contact surface 7*a* of each cured body 74 does not spread to a position to come into contact with the bonding pad and the like on board 6.

Figure 18:
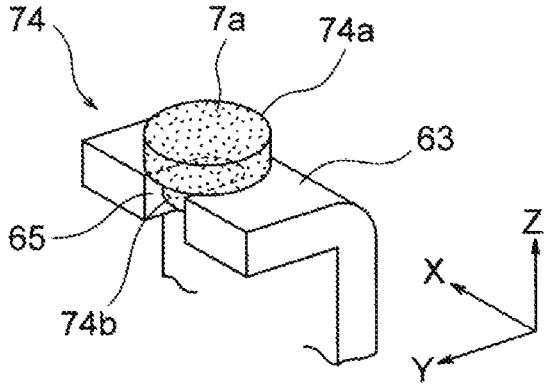
FIG. 18 is a schematic diagram illustrating an example of a three-dimensional shape of the cured body of the third embodiment.

FIG. 18 is a schematic diagram illustrating an example of a shape of cured body 74. Cured body 74 includes: large diameter part 74*a* of a substantially cylindrical shape, which is cured on the surface of holder part 63 or 64; and small diameter part 74*b* which is cured after entering groove portion 65 or 66.

As described above, in the third embodiment of the invention, the area of each board contact surface 7*a* is limited by providing each of hold parts 63 and 64 of holder 3 with the corresponding groove portion 65 or 66. Accordingly, the width of board 6 can be reduced while avoiding any contact of board contact surface 7*a* with the bonding pad and like on board 6. This makes it possible to reduce the width of LED head 15. In other words, the third embodiment can contribute to the reduction in size of LED head 15 in addition to the effects described in the first embodiment.

Note that the third embodiment can also be combined with any of the first modified examples of the first embodiment and the second embodiment.

Fourth Embodiment

Next, a fourth embodiment of the invention is described. An object of the fourth embodiment is to prevent cured bodies 75 from falling off by securing a contact area between hold part 35 or 36 and each cured body 75.

Figure 19A:
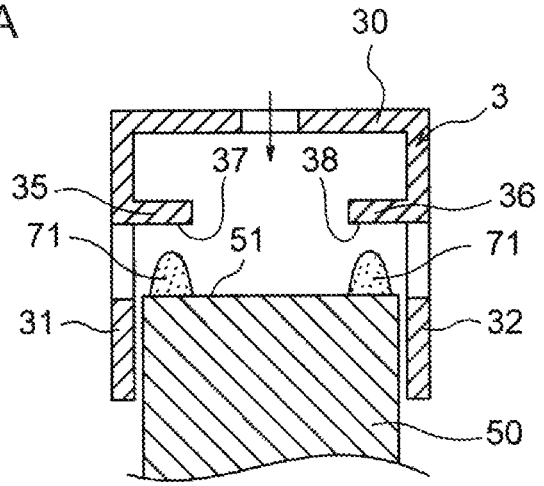
FIGS. 19A to 19C are schematic diagrams for explaining a problem to be solved by a fourth embodiment.
Figure 19B:
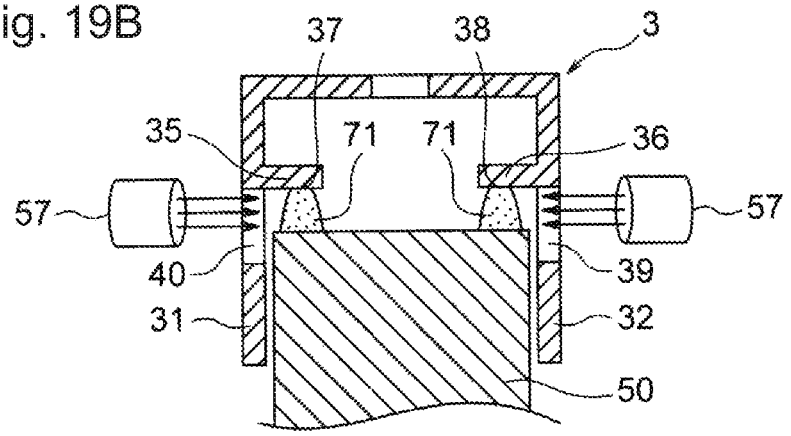
Figure 19C:
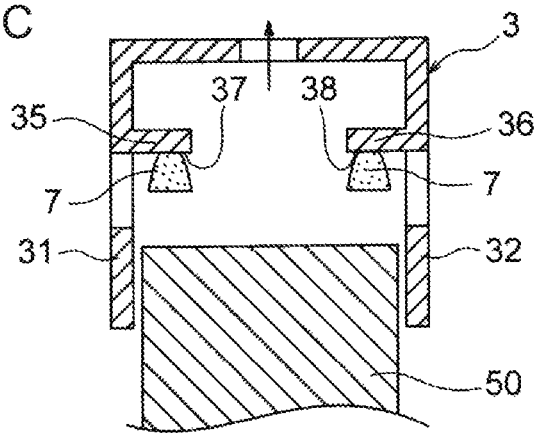

FIGS. 19A to 19C are schematic diagrams for explaining a problem to be solved by the fourth embodiment, which illustrate a method of forming cured bodies 7. As illustrated in FIG. 19A, when curable material 71 is applied to reference surface 51 of jig 50, curable material 71 is apt to forma shape of a mound (i.e., a shape in which cross sections parallel to reference surface 51 gradually shrink from the bottom up).

Thereafter, curable material 71 is pressed with hold parts 35 and 36 of holder 3 as illustrated in FIG. 19B. At this time, depending on the amount of pressure on the curable material 71, there may be a case where a sufficiently large contact area between cured body 7 and each hold part 35 or 36 is not obtained.

In such a case, if curable material 71 is irradiated with ultraviolet rays from UV irradiators 57, then curable material 71 having the small contact area with hold part 35 or 36 is cured and formed into cured body 7.

Then, if holder 3 is pulled up along guide pins 53 and 54 as illustrated in FIG. 19C, cured bodies 7 in the state of unstable adhesion to hold parts 35 and 36 are likely to be obtained. For this reason, when board 6 is pressed against board contact surfaces 7*a* of cured bodies 7, or at the time of position adjustments using eccentric cams 91 and 92 (FIG. 4), cured bodies 7 are prone to fall off holder 3.

Accordingly, in the fourth embodiment, the contact area between each cured body 75 and hold part 35 or 36 is secured as described below. Note that the configuration of LED head 15 of the fourth embodiment is the same as that of the first embodiment except for the shape of each cured body 75.

Figure 20A:
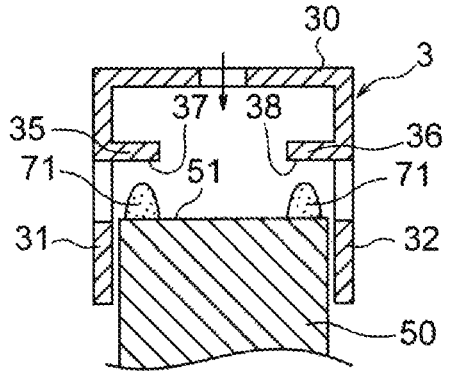
FIGS. 20A to 20D are schematic diagrams for explaining a method of forming a cured body of an LED head of the fourth embodiment.

FIGS. 20A to 20D illustrate a method of forming cured bodies 75 of the fourth embodiment. Jig 50 described in the first embodiment is used in the fourth embodiment. Note that any illustration of groove 51*a* (FIG. 5) in jig 50 is omitted. First, as illustrated in FIG. 20A, curable material 71 is applied to reference surface 51 of jig 50. In this case, curable material 71 forms a shape of a mound like in FIG. 19A.

Figure 20B:
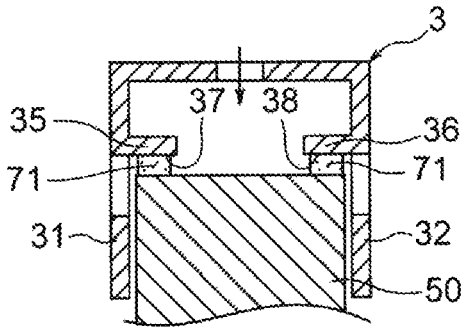

Next, as illustrated in FIG. 20B, holder 3 is retained in such a way as to direct bottom portion 30 upward, and is located above jig 50. Then, holder 3 is moved down along guide pins 53 and 54 (FIG. 5). As holder 3 is moved down, hold parts 35 and 36 press curable material 71. At this time, curable material 71 is pressed to such a thickness smaller than a target thickness of cured bodies 75. This action can be achieved, for example, by setting the height of each of stopper pins 55 and 56 (FIG. 5) smaller by a given amount than that of the first embodiment.

Figure 20C:
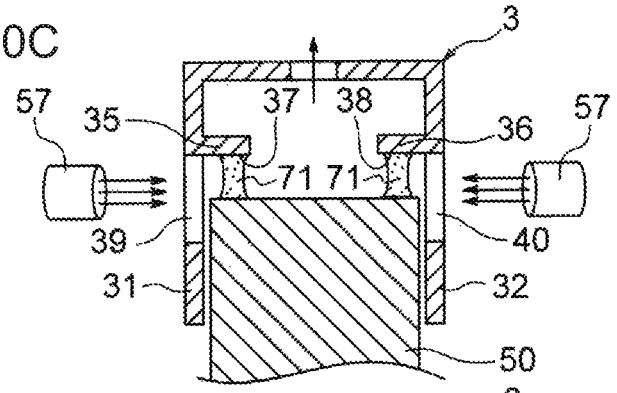

Thereafter, as illustrated in FIG. 20C, holder 3 is moved up until the thickness of curable material 71 coincides with the target thickness of cured bodies 75. This action can be achieved, for example, by moving up stopper pins 55 and 56, which are in contact withholder 3 in the step of FIG. 20B, by the given amount. At this time, curable material 71 is formed into such a shape (a shape like a bobbin) that a dimension (an outside diameter, i.e., a diameter) or an area of each of two end portions in its vertical direction is larger than a dimension (an outside diameter, i.e., a diameter) or a cross-sectional area of a cross section at its central part. In this state, curable material 71 is irradiated with ultraviolet rays from UV irradiators 57 and is formed into cured bodies 75.

Figure 20D:
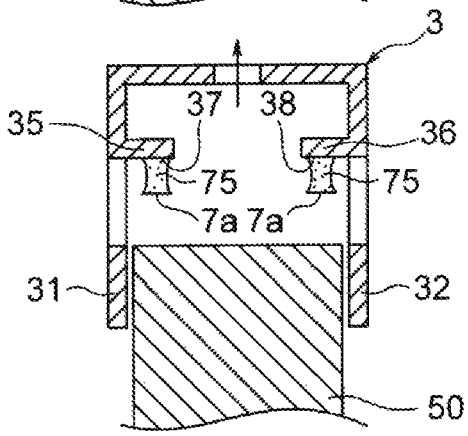

Then, as illustrated in FIG. 20D, when holder 3 is pulled up along guide pins 53 and 54, cured bodies 75 are detached from reference surface 51 while adhering to hold parts 35 and 36. The surfaces of cured bodies 75 previously in contact with reference surface 51 constitute board contact surfaces 7*a*.

Figure 21A:
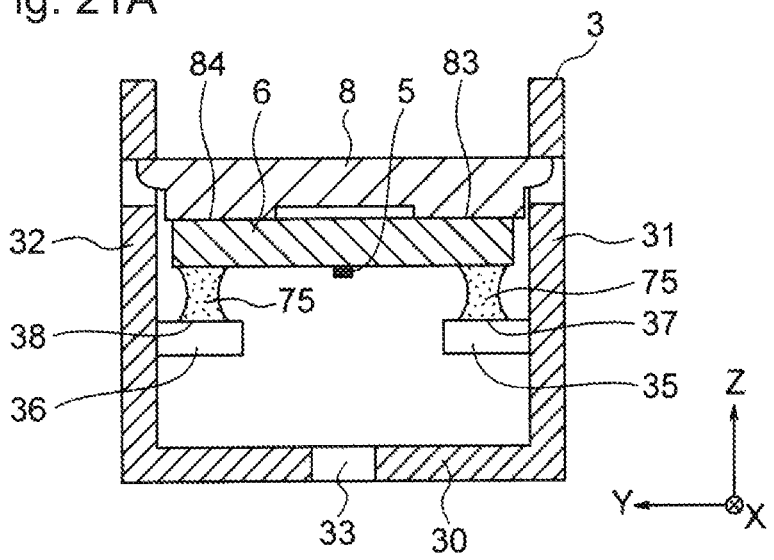
FIG. 21A is a cross-sectional view illustrating the LED head of the fourth embodiment and FIG. 21B is a schematic diagram illustrating an example of a shape of the cured body.

Thereafter, as illustrated in FIG. 21A, holder 3 is retained in such a way as to direct bottom portion 30 downward, and board 6 is placed on board contact surfaces 7*a* of cured bodies 75. Subsequently, press member 8 is attached onto board 6, and then holder 3, board 6, and press member 8 are assembled together. Thereafter, rod lens array 2 (FIG. 2) is attached to opening 33 of holder 3 as described in the first embodiment.

Figure 21B:
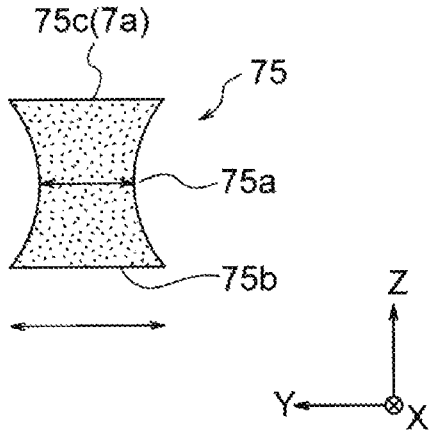

FIG. 21B is aside view illustrating an example of the shape of cured body 75 described in the fourth embodiment. The cured body 75 has the shape (a shape like a bobbin) in which the dimension (the outside diameter, i.e., the diameter) or the area of each of two end portions 75*b* and 75*c* in the Z direction (the vertical direction, i.e., the optical axis direction of rod lens array 2) is larger than the dimension (the outside diameter, i.e., the diameter) or the cross-sectional area of the cross section at central part 75*a*. Accordingly, it is possible to secure the sufficiently large contact area between the cured body 75 and each of hold parts 35 and 36 of holder 3. As a consequence, the cured bodies 75 can reliably adhere to hold parts 35 and 36 and be effectively prevented from falling off holder 3.

As described above, according to the fourth embodiment of the invention, cured body 75 has the shape in which the dimension or the area of each of two end portions 75*b* and 75*c* in the Z direction is larger than the dimension or the cross-sectional area of the cross section at central part 75*a*. Thus, it is possible to secure the sufficient contact area between the cured body 75 and each of hold parts 35 and 36, and to effectively prevent hold parts 35 and 36 from falling off.

Note that the fourth embodiment can also be combined with any of the first modified examples of the first embodiment, the second embodiment, and the third embodiment.

Fifth Embodiment

Next, a fifth embodiment of the invention is described. As with the above-described fourth embodiment, an object of the fifth embodiment is to prevent cured bodies 76 from falling off by securing a contact area between cured body 76 and each of hold parts 35 and 36.

The configuration of LED head 15 of the fifth embodiment is the same as that of the first embodiment except for the shape of each cured body 76.

Figure 22A:
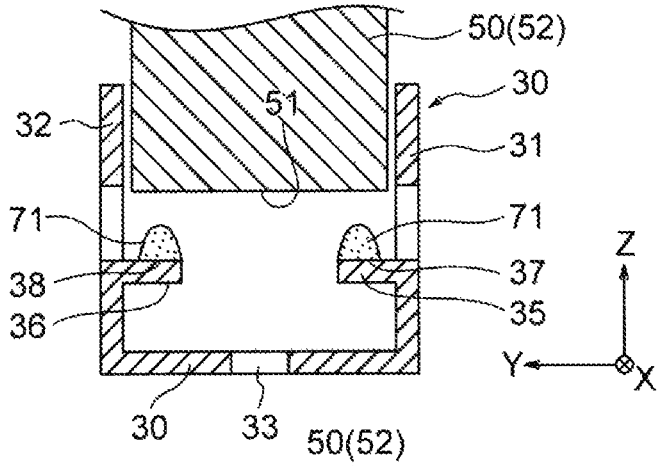
FIGS. 22A to 22C are schematic diagrams for explaining a method of forming a cured body of an LED head of a fifth embodiment.
Figure 22B:
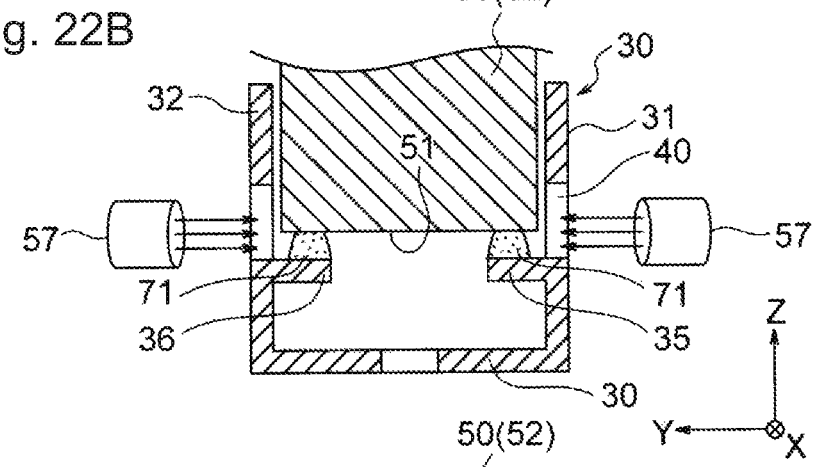
Figure 22C:
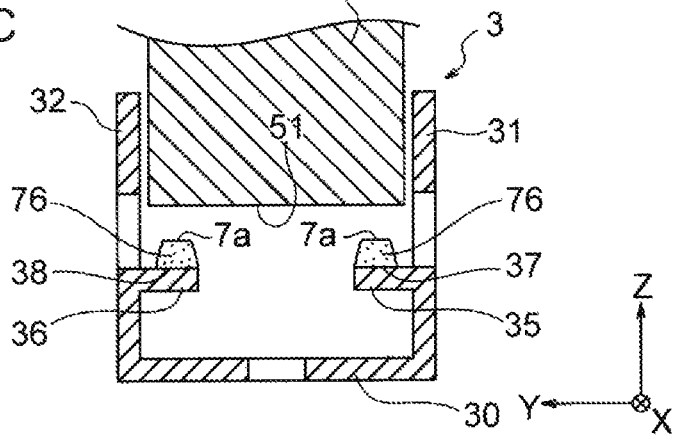

FIGS. 22A to 22C illustrate a method of forming cured bodies 76 of the fifth embodiment. While jig 50 described in the first embodiment is used in the fifth embodiment, the vertical relation between holder 3 and jig 50 is reversed from that in the first embodiment. Moreover, guide pins 53 and 54 and stopper pins 55 and 56 illustrated in FIG. 5 are designed to guide and control the position of jig 50 in the vertical direction.

First, as illustrated in FIG. 22A, holder 3 is retained in such a way as to direct bottom portion 30 downward. Then, curable material 71 is applied to reception surfaces 37 and 38 of hold parts 35 and 36 of holder 3. Next, insertion portion 52 (FIG. 5) of jig 50 is inserted from above into holder 3.

Next, as illustrated in FIG. 22B, jig 50 is moved down so as to press curable material 71 on hold parts 35 and 36 with reference surface 51 of jig 50. Moreover, curable material 71 is irradiated with ultraviolet rays from UV irradiators 57 and is cured and formed into cured bodies 76.

Then, jig 50 is pulled up as illustrated in FIG. 22C. The surface of jig 50 is provided with a resin coating so as to avoid adhesion of cured bodies 76. Accordingly, cured bodies 76 remain on hold parts 35 and 36. Surfaces of cured bodies 76 previously in contact with reference surface 51 constitute board contact surfaces 7*a*.

Thereafter, as described with reference to FIG. 21A, board 6 is placed on board contact surfaces 7*a* of cured bodies 76. Subsequently, press member 8 is attached onto board 6, and then holder 3, board 6, and press member 8 are assembled together. Then, rod lens array 2 (FIG. 2) is attached to opening 33 of holder 3 as described in the first embodiment.

Figure 23:
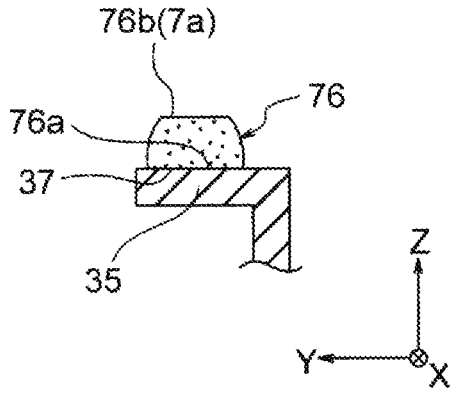
FIG. 23 is a schematic diagram illustrating an example of a shape of the cured body of the fifth embodiment.

FIG. 23 is a side view illustrating the shape of cured body 76 described in the fifth embodiment. The cured body 76 has such a shape that a dimension (an outside diameter, i.e., a diameter) or an area of end portion 76*a* (i.e., a lower end) in contact with hold part 35 or 36 of holder 3 is larger than a dimension (an outside diameter, i.e., a diameter) or an area of end portion 76*b* (i.e., board contact surface 7*a*) on the other side. Accordingly, it is possible to secure the sufficiently large contact area between the cured body 76 and each of hold parts 35 and 36 of holder 3. Cured bodies 76 can be reliably attached to hold parts 35 and 36. Thus, cured bodies 76 can be effectively prevented from falling off.

Moreover, it is possible to keep the area of board contact surface 7*a* of cured body 76 relatively small, and thus to prevent cured body 76 from coming into contact with the bonding pad and the like on board 6.

As described above, according to the fifth embodiment of the invention, cured body 76 has a shape in which the dimension or the area of end portions 76*a* that comes into contact with hold part 35 or 36 is larger than the dimension or the area of board contact surface 7*a*. Thus, it is possible to secure the sufficient contact area between the cured body 76 and each of hold parts 35 and 36, and to effectively prevent hold parts 35 and 36 from falling off.

Note that the fifth embodiment can also be combined with any of the first modified examples of the first embodiment, the second embodiment, the third embodiment, and the fourth embodiment.

Sixth Embodiment

Next, a sixth embodiment of the invention is described. The sixth embodiment suppresses adhesion of dust to rod lens array 2 and LED array chip 5 by closing openings 39 and 40 of holder 3 with shield sheets 300.

Figure 24:
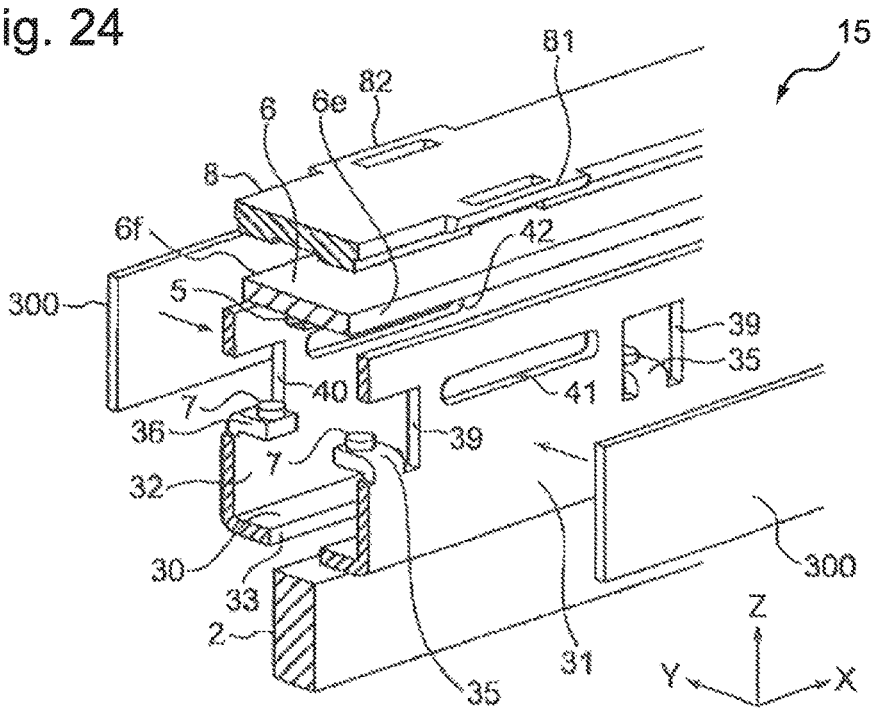
FIG. 24 is an exploded perspective view illustrating an LED head according to a sixth embodiment.
Figure 25:
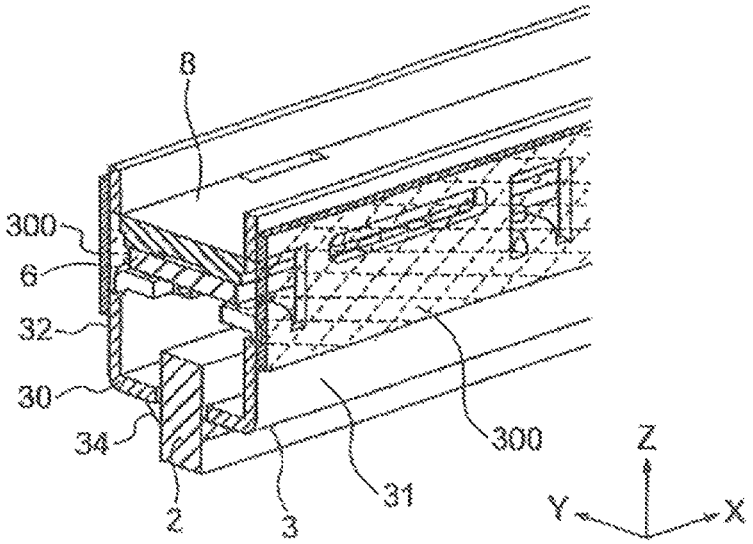
FIG. 25 is a perspective view illustrating the LED head according to the sixth embodiment.

FIG. 24 is an exploded perspective view and FIG. 25 is a perspective view, each of which illustrates LED head 15 in the sixth embodiment. As illustrated in FIG. 24, shield sheets 300 as a shield member (cover member) are attached to the respective outer surfaces in the Y direction of side wall portions 31 and 32 of holder 3.

As described in the first embodiment, openings 39 and 40 are formed in the portions of side wall portions 31 and 32 of holder 3 where hold pars 35 and 36 are cut out. Shield sheets 300 are attached to side wall portions 31 and 32 of holder 3. Thereby, shield sheets 300 close openings 39 and 40.

Shield sheet 300 is, for example, a rectangular sheet which is longer in the X direction. It is desirable that one shield sheet 300 attached to side wall portion 31 close all openings 39, and one shield sheet 300 attached to side wall portion 32 close all openings 40. However, multiple shield sheets 300 may be attached to each of side wall portions 31 and 32.

Here, shield sheets 300 close not only openings 39 and 40, but also slits 41 and 42. However, since each of slits 41 and 42 is engaged and closed with corresponding engagement piece 81 or 82 actually, shield sheets 300 may be configured not to close slits 41 and 42.

Figure 26:
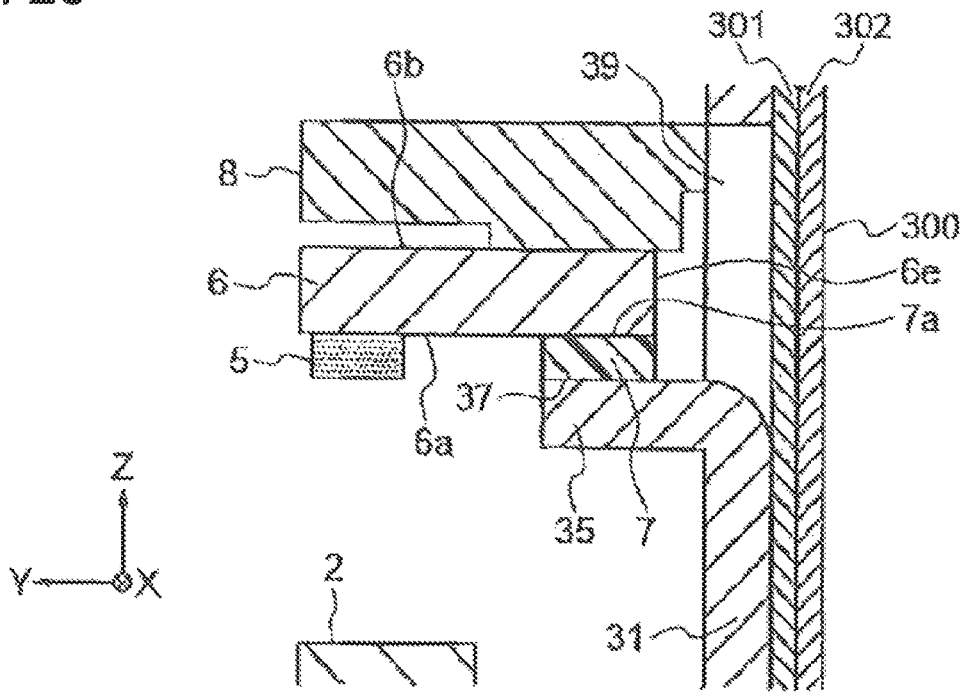
FIG. 26 is a cross-sectional view illustrating a portion where a shield sheet for the LED head according to the sixth embodiment is attached.

FIG. 26 is an enlarged cross-sectional view illustrating a portion of side wall portion 31 to which shield sheet 300 is attached. Shield sheet 300 has a two-layer structure of base material layer 302 and adhesion layer 301. Adhesion layer 301 of shield sheet 300 is in contact with side wall portion 31. For this reason, adhesion layer 301 of shield sheet 300 is exposed to the board 6 side (inner side of holder 3) through opening 39 of side wall portion 31.

While FIG. 26 illustrates shield sheet 300 attached to side wall portion 31, shield sheet 300 attached to side wall portion 32 (FIG. 25) also has a two-layer structure of base material layer 302 and adhesion layer 301, and adhesion layer 301 is in contact with side wall portion 32. In other words, adhesion layer 301 of shield sheet 300 is exposed to the board 6 side (inner side of holder 3) through opening 40 (FIG. 25) of side wall portion 32.

Adhesion layer 301 of shield sheet 300 attached to side wall portion 31 or 32 is opposed to each of both end surfaces 6*e* and 6*f* (FIG. 24) in the Y direction of board 6. In addition, each shield sheet 300 is disposed at least in a range in the Z direction, the range being from lower surface 6*a* (first surface on which LED array chip 5 is formed) to upper surface 6*b* (second surface on the opposite side of LED array chip 5) of board 6.

In the manufacture of LED head 15 of the sixth embodiment, it is desirable to assemble holder 3, rod lens array 2, board 6, and press member 8 together and thereafter to attach shield sheets 300 to side wall portions 31 and 32 of holder 3, as described with reference to FIGS. 7A and 7B. Note that a method of forming cured body 7 of holder 3 is the same as described in the first embodiment.

Figure 27:
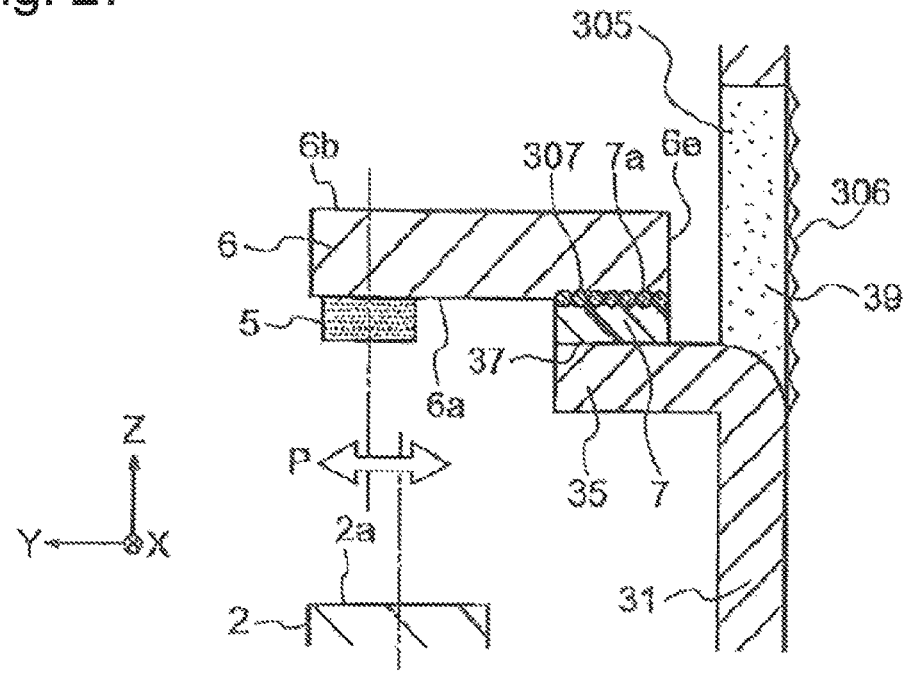
FIG. 27 is a schematic diagram for explaining operation and effects of the shield sheet according to the sixth embodiment.

FIG. 27 is a schematic diagram for explaining operation and effects of the sixth embodiment, and is an enlarged cross-sectional view illustrating an area of side wall portion 31 where hold part 35 is formed. As described in the first embodiment, holder 3 is manufactured by performing press work on a sheet metal material. For this reason, due to punching of a press work machine to form hold pars 35 and 36 (FIG. 27 illustrates only hold part 35) from side wall portions 31 and 32 (FIG. 27 illustrates only side wall portion 31), burr 306 may be produced on peripheries of openings 39 and 40 (FIG. 27 illustrates only opening 39).

In addition, in order to reduce the manufacturing costs of holder 3, it is desirable to press a sheet metal material already subjected to corrosion resistance treatment, and not to perform a second corrosion resistance treatment on the sheet metal material after press work. Hence, inner surfaces (edges) of openings 39 and 40 formed by press work are not subjected to corrosion resistance treatment, and thus corrosion 305 may occur on the inner surfaces of openings 39 and 40 with passage of time.

Moreover, in the process of bending hold parts 35 and 36 at an approximately right angle to respective side wall portions 31 and 32, a bending punch slides on a surface of the sheet metal material, which may cause the surface layer treated for corrosion resistance to come off.

Furthermore, after board 6 is attached to holder 3, a position of board 6 is adjusted (finely adjusted) onboard contact surface 7*a* in some cases as indicated by arrow P in order to align LED array chip 5 in the Y direction relative to rod lens array 2. At the time of this position adjustment, it is probable that the surface of board 6 or board contact surface 7*a* wears away and wear debris 307 is produced.

When the burr, the corrosion, pieces of the surface layer which have come off, or the wear debris (collectively referred to as "dust") generated as described above adheres to incidence surface 2*a* of rod lens array 2 or the surface of LED array chip 5 for some reason, image quality deteriorates.

However, since holder 3 is made of board metal material, i.e., electric conductor, holder 3 has a property of attracting the dust described above. Moreover, adhesion layers 301 of shield sheets 300 are exposed to an inner region of holder 3 through openings 39 and 40. For these reasons, the dust adheres to adhesion layers 301 of shield sheets 300 through openings 39 and 40. In such a manner, a dust capturing action by adhesion layers 301 of shield sheets 300 makes it possible to suppress adhesion of the dust to incidence surface 2*a* of rod lens array 2 or the surface of LED array chip 5.

As described above, according to the sixth embodiment of the invention, shield sheets 300 are attached to side wall portions 31 and 32 of holder 3, and adhesion layers 301 of shield sheets 300 are exposed to the inner side of holder 3 (the board 6 side) through openings 39 and 40. As a result, it is possible to capture the dust generated in holder 3 with adhesion layers 301 of shield sheets 300, and to suppress adhesion of the dust to incidence surface 2*a* of rod lens array 2 or the surface of LED array chip 5. Hence, deterioration of image quality attributable to adhesion of the dust can be suppressed.

What is more, shield sheets 300 are provided opposite to both end surfaces 6*e* and 6*f* in the Y direction of board 6. Thus, it is possible to enhance an effect of suppressing adhesion of the dust to LED array chip 5 mounted on board 6.

Note that the sixth embodiment can also be combined with any of the first modified examples of the first embodiment, the second embodiment, the third embodiment, the fourth embodiment, and the fifth embodiment.

Seventh Embodiment

Next, a seventh embodiment of the invention is described. In the seventh embodiment, heights (positions in the Z direction) of board contact surfaces 7*a* of multiple cured bodies 7 are varied in the X direction depending on the warpage of rod lens array 2.

Figure 28:
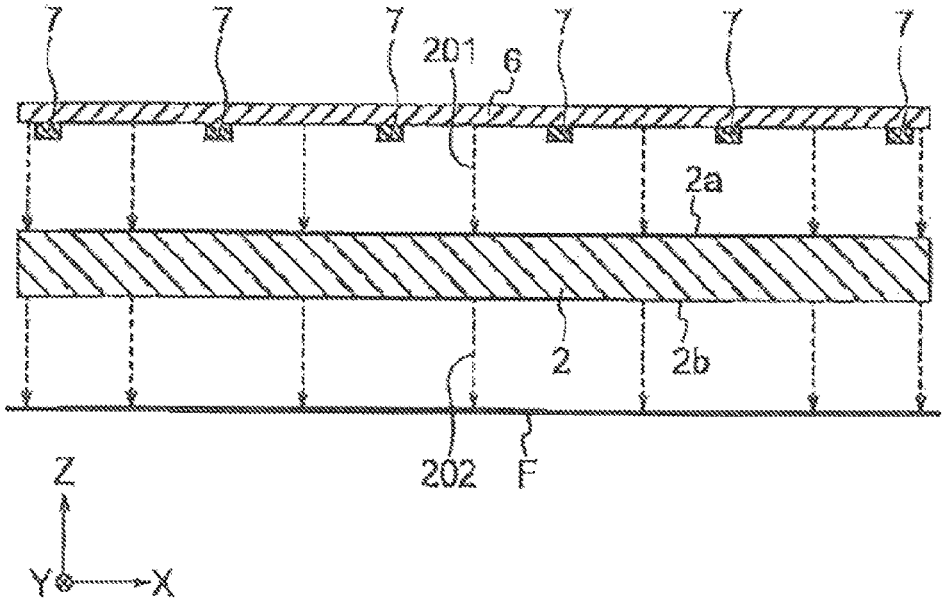
FIG. 28 is a diagram schematically illustrating a relation among a board, a rod lens array, and a focus surface.

FIG. 28 is a diagram schematically illustrating a relation among board 6, rod lens array 2, and focus surface F (the surface of photoconductor drum 13). As described in the first embodiment, board 6 is positioned by being brought into contact with multiple cured bodies 7 (board contact surfaces 7*a*) arranged along the X direction.

Light 201 emitted from LED array chip 5 (omitted in FIG. 28) of board 6 is made incident on incidence surface 2*a* of rod lens array 2, and light 202 emitted from emission surface 2*b* of rod lens array 2 focuses on focus surface F. In an ideal condition, the height of board 6 is constant in the X direction, and the height of rod lens array 2 is also constant in the X direction.

In other words, in the ideal condition, a distance between LED array chip 5 and incidence surface 2*a* of rod lens array 2 is constant in the X direction, and a distance between emission surface 2*b* of rod lens array 2 and focus surface F is also constant in the X direction. Thus, a line image straight in the X direction is formed on focus surface F.

Meanwhile, rod lens array 2 warps in some cases. In this case, the distance between LED array chip 5 and incidence surface 2*a* of rod lens array 2 varies in the X direction, and the distance between emission surface 2*b* of rod lens array 2 and focus surface F also varies in the X direction. As a consequence, light fails to focus on focus surface F, resulting in a failure of image formation.

Figure 29:
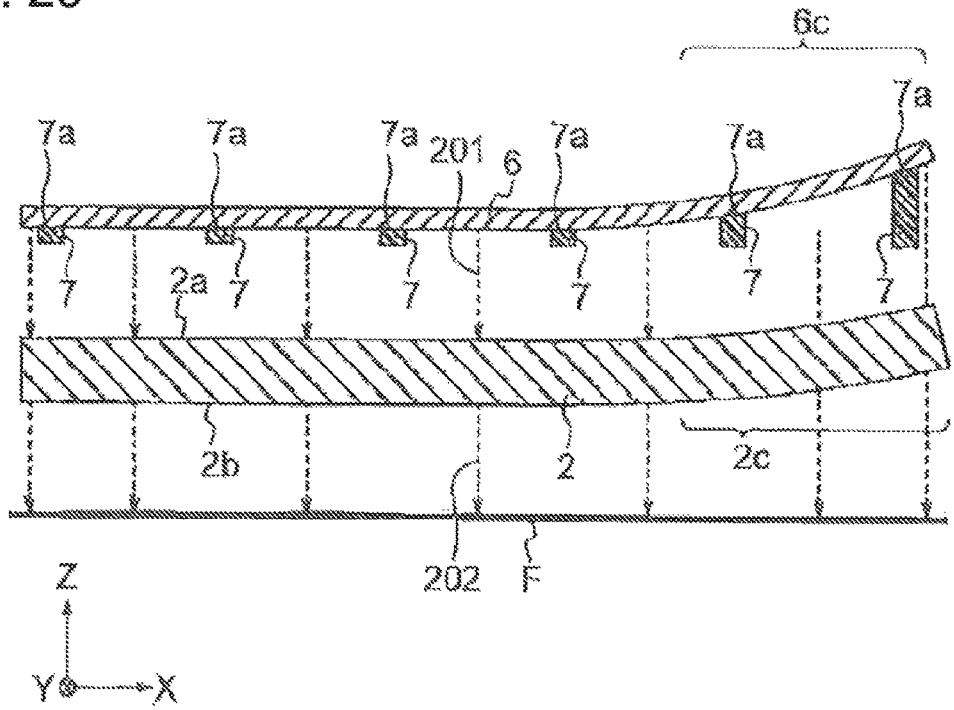
FIG. 29 is a diagram schematically illustrating a relation among a board, cured bodies, a rod lens array, and a focus surface according to a seventh embodiment.

FIG. 29 is a diagram schematically illustrating a relation among board 6, rod lens array 2, and focus surface Fin the seventh embodiment. In FIG. 29, end portion region 2*c* in a +X direction of rod lens array 2 is warped in a +Z direction (toward the board 6). In this embodiment, the height (position in the Z direction) of board contact surface 7*a* of each of cured bodies 7 supporting board 6 is varied in the X direction depending on the warpage of rod lens array 2.

When end portion region 2*c* in the +X direction of rod lens array 2 warps in the +Z direction as illustrated in FIG. 29, the heights of board contact surfaces 7*a* of cured bodies 7 are set such that end portion region 6*c* in the +X direction of board 6 is also displaced in the +Z direction.

Figure 30:
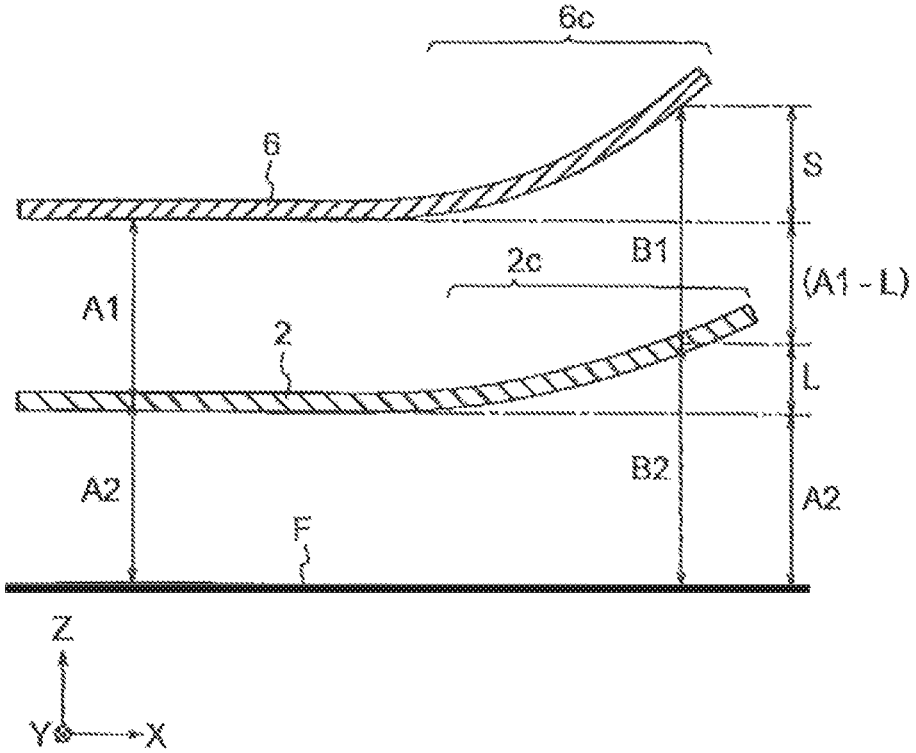
FIG. 30 is a schematic diagram illustrating a shape of an end portion in a longitudinal direction of each of the rod lens array and the board according to the seventh embodiment.

FIG. 30 is a schematic diagram illustrating shapes of rod lens array 2 and board 6. As illustrated in FIG. 30, in a region where light emitted from rod lens array 2 focuses on focus surface F (in other words, a failure of image formation does not occur), a working distance on the incidence side of rod lens array 2 (distance between incidence surface 2*a* and LED array chip 5) is denoted by A1, and a working distance on the emission side thereof (distance between emission surface 2*b* and focus surface F) is denoted by A2. Working distance A1 and working distance A2 are equal to each other (A1=A2).

In end portion region 2*c* where rod lens array 2 warps, on the other hand, a working distance on the incidence side of rod lens array 2 is denoted by B1, and a working distance on the emission side thereof is denoted by B2. When working distance B1 and working distance B2 is equal to each other (B1=B2), light emitted from rod lens array 2 focuses on focus surface F.

Provided that a warpage amount in the +Z direction of rod lens array 2 at a certain position in the X direction in end portion region 2*c* (=B2−A2) is denoted by L, and a displacement amount in the +Z direction of board 6 is denoted by S, light emitted from rod lens array 2 can be made to focus on focus surface F if displacement amount S of board 6 is twice warpage amount L of rod lens array 2 (S=2×L).

For this reason, in the seventh embodiment, a state of warpage of rod lens array 2 is measured in advance, and board contact surfaces 7*a* of cured bodies 7 are formed so as to displace board 6 by twice the warpage amount in the same direction as the direction of warpage of rod lens array 2.

Figure 31:
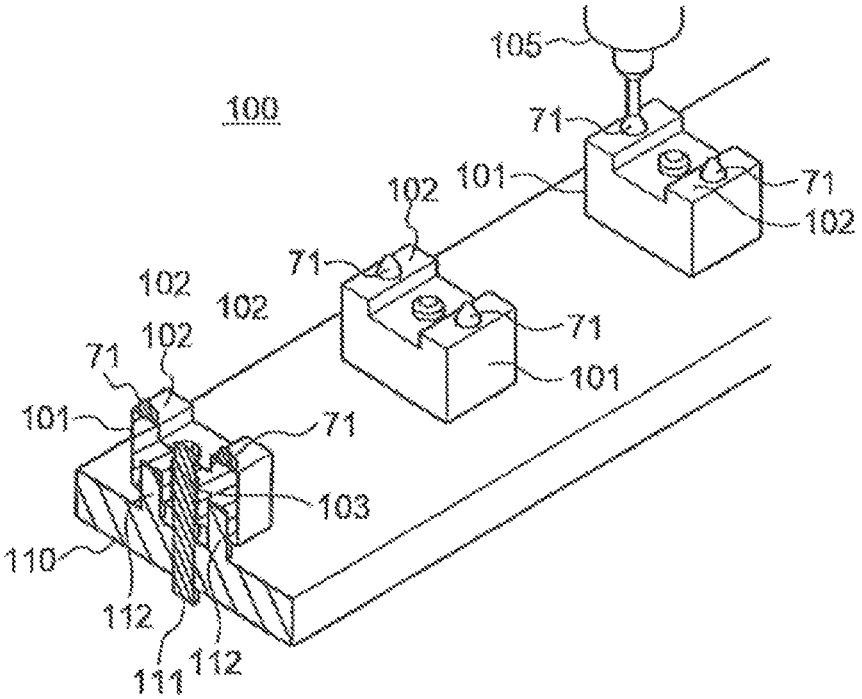
FIG. 31 is a schematic diagram illustrating a jig used for formation of the cured bodies in the seventh embodiment.

Next, a method of forming cured bodies 7 including board contact surfaces 7*a* is described. FIG. 31 is a schematic diagram illustrating jig 100 used for formation of cured bodies 7. Jig 100 includes base 110 placed horizontally, and multiple movable members 101 arranged in a line on base 110. The number and the arrangement of movable members 101 correspond to the number and the arrangement of pairs of hold parts 35 and 36 of side wall portions 31 and 32 of holder 3.

Each of movable members 101 is movably guided in the vertical direction by guide portions 112 arranged on base 110. In addition, movable member 101 includes nut portion 103 (female screw portion) to be engaged with ball screw 111 which penetrates base 110 in the vertical direction.

The upper surfaces of movable member 101 serve as reference surfaces 102 which are flat and parallel to the horizontal plane. A flatness of reference surface 102 is the same as that of reference surface 51 (FIG. 5) of the first embodiment. Reference surface 102 is provided with, for example, a resin (such as silicone resin) coating so as to avoid adhesion of cured bodies 7. Curable material 71 described in the first embodiment is applied to (dripped on) reference surfaces 102 of movable member 101 using, for example, dispenser 105.

Holder 3 is guided in such a direction (the vertical direction) to approach and recede from jig 100 by guide pins 53 and 54 (FIG. 5) described in the first embodiment. Besides, the position in the Z direction of holder 3 is controlled by stopper pins 55 and 56 (FIG. 5) described in the first embodiment.

Figure 32:
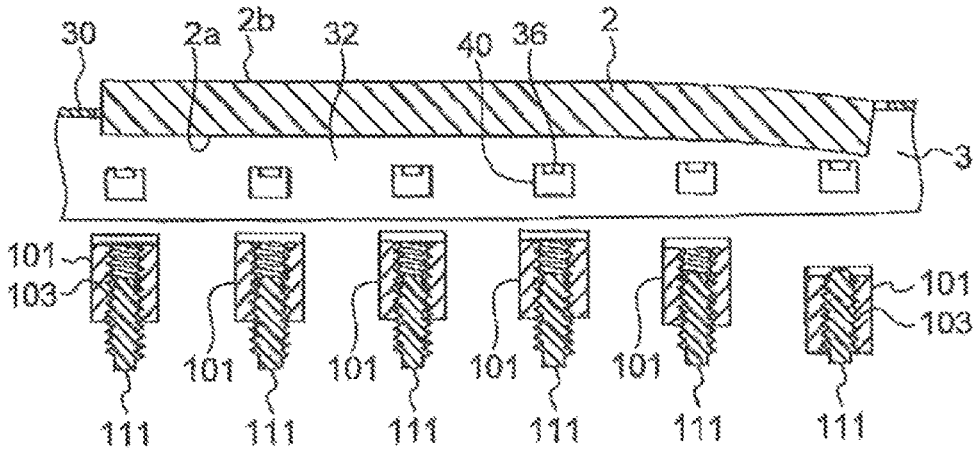
FIG. 32 is a schematic diagram illustrating movable members of the jig, a holder, and the rod lens array according to the seventh embodiment.

FIG. 32 is a schematic diagram illustrating a positional relation among movable members 101, holder 3, and rod lens array 2 attached to holder 3. As illustrated in FIG. 32, the position in the vertical direction (optical axis direction of rod lens array 2) of each movable member 101 is adjusted depending on the warpage of rod lens array 2. The position adjustment in the vertical direction of movable members 101 is carried out by rotating ball screws 111.

Figure 33:
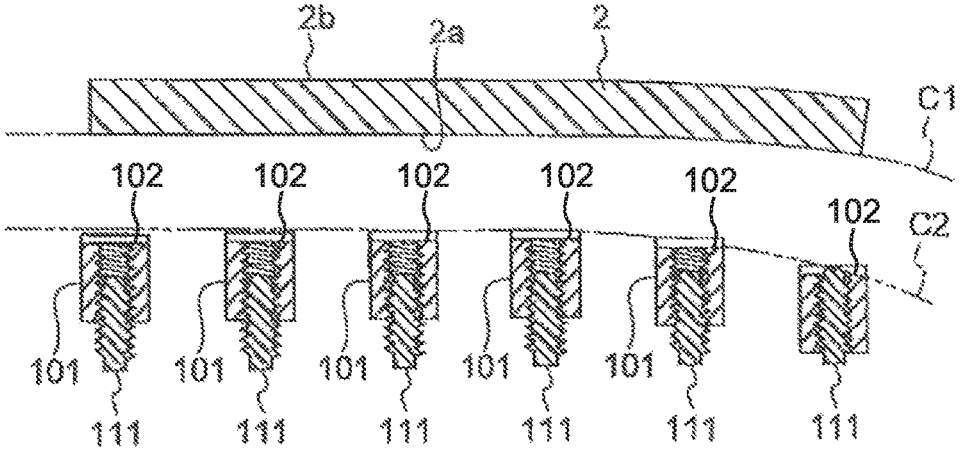
FIG. 33 is a schematic diagram illustrating a relation between warpage of the rod lens array and a height of each of the movable members of the jig, according to the seventh embodiment.

FIG. 33 is a schematic diagram illustrating a relation between the warpage of rod lens array 2 and the height of each movable member 101 of jig 100, where holder 3 is omitted. As illustrated in FIG. 33, the height (position in the vertical direction) of incidence surface 2*a* of rod lens array 2 fixed to holder 3 is measured using, for example, a laser length measurement unit or a linear gauge sensor. The measurement is carried out at equal intervals in a longitudinal direction of rod lens array 2.

The position in the vertical direction of each movable member 101 is adjusted using ball screw 111 based on a measurement result of the height of rod lens array 2. In this process, the position in the vertical direction of each movable member 101 is adjusted such that a displacement amount (curve C2) in the vertical direction of the upper end surfaces (reference surfaces 102) of movable member 101 at any position in the longitudinal direction is twice a warpage amount (curve C1) of rod lens array 2 at that position.

Figure 34:
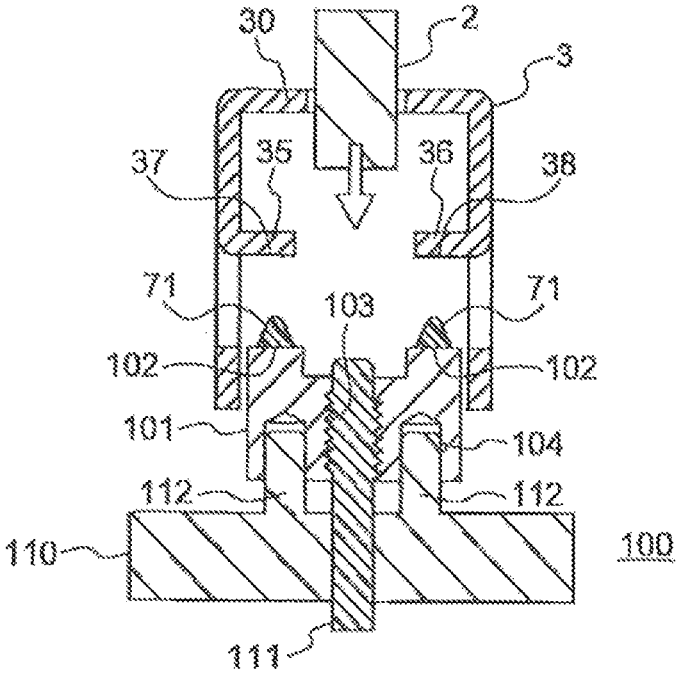
FIG. 34 is a schematic diagram for explaining a method of forming the cured bodies according to the seventh embodiment.
Figure 35:
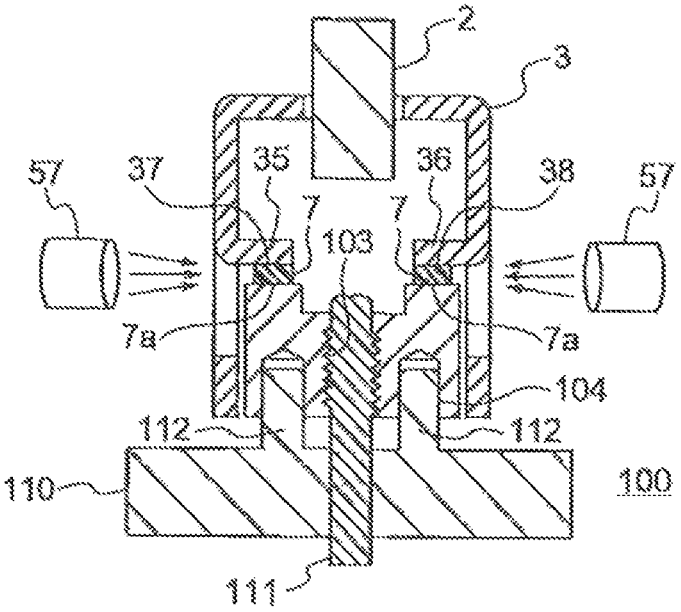
FIG. 35 is a schematic diagram for explaining the method of forming the cured bodies according to the seventh embodiment.
Figure 36:
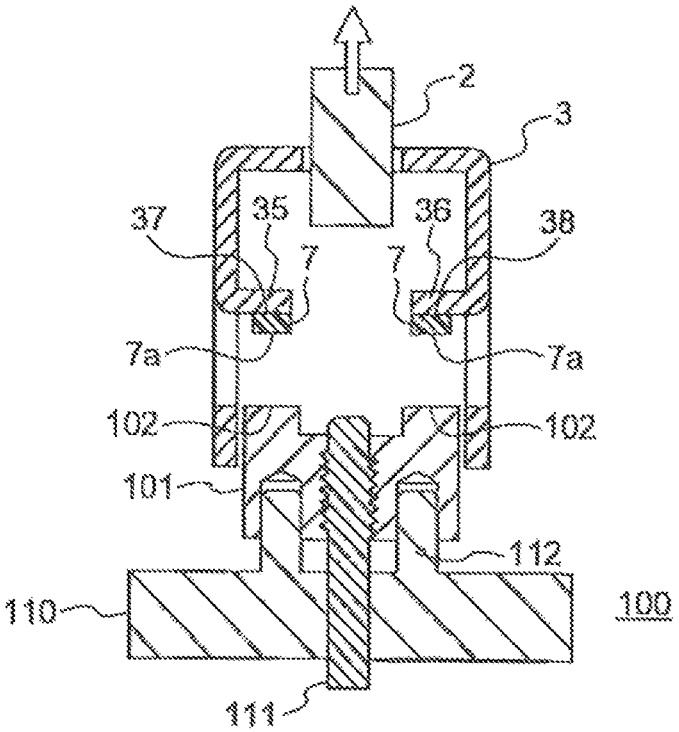
FIG. 36 is a schematic diagram for explaining the method of forming the cured bodies according to the seventh embodiment.

FIG. 34, FIG. 35, and FIG. 36 are schematic diagrams for explaining a process after the position in the vertical direction of each movable member 101 of jig 100 is adjusted. First, as illustrated in FIG. 34, holder 3 to which rod lens array 2 is fixed is retained in such a way as to direct bottom portion 30 upward, and is located above jig 100. Then, holder 3 is moved down along guide pins 53 and 54 (FIG. 5).

As illustrated in FIG. 35, when holder 3 is moved down, hold parts 35 and 36 of holder 3 come into contact with curable material 71 on movable member 101 and presses curable material 71. Then, holder 3 is further moved down to come into contact with stopper pins 55 and 56 (FIG. 5), and the downward movement of holder 3 is thus stopped. At this time, the amount of press on curable material 71 differs depending on the position in the vertical direction of movable member 101.

Subsequently, as illustrated in FIG. 35, curable material 71 is subjected to UV irradiation by using UV irradiators 57, and curable material 71 is thus cured. Here, UV irradiators 57 irradiate curable material 71 with ultraviolet rays through openings 39 and 40 of side wall portions 31 and 32 of holder 3. In this way, curable material 71 is cured and formed into cured bodies 7 mentioned above. Cured bodies 7 are in the state of adhering (i.e., being attached) to reception surfaces 37 and 38 of hold parts 35 and 36.

Then, as illustrated in FIG. 36, holder 3 is pulled up in the vertical direction from jig 100. Reference surface 102 of movable member 101 of jig 100 is provided with a resin coating so as to avoid adhesion of cured bodies 7. Accordingly, cured bodies 7 in the state of adhering to hold parts 35 and 36 are detached from reference surface 102. Hence, the surfaces of cured bodies 7 previously in contact with reference surface 102 constitute board contact surfaces 7*a*. As a consequence, holder 3 on which cured bodies 7 with board contact surfaces 7*a* are arranged is obtained.

Figure 37:
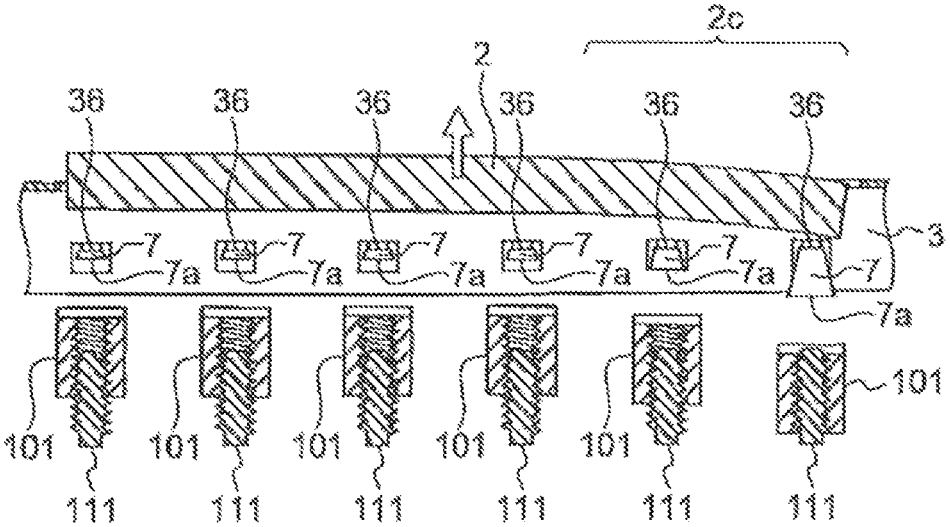
FIG. 37 is a schematic diagram for explaining a height of a board contact surface of each cured body in a process illustrated in FIG. 36.

FIG. 37 is a schematic diagram for explaining multiple cured bodies 7 formed in the process illustrated in FIG. 36. As illustrated in FIG. 37, in a region where the height of movable member 101 is large, the amount of press on corresponding curable material 71 is large, and thus the thickness of curable body 7 is small. On the other hand, in a region where the height of movable member 101 is small, the amount of press on corresponding curable material 71 is small, and thus the thickness of curable body 7 is large. As described above, the thicknesses of cured bodies 7 vary in the longitudinal direction (i.e., the longitudinal direction of holder 3) of rod lens array 2 depending on the warpage of rod lens array 2.

Thereafter, as described with reference to FIGS. 7A and 7B in the first embodiment, board 6 is placed on board contact surfaces 7*a* of cured bodies 7 and press member 8 is attached onto board 6. At this time, as illustrated in FIG. 29, since the positions in the Z direction of board contact surfaces 7*a* of cured bodies 7 of holder 3 vary in the X direction depending on the warpage of rod lens array 2, it is possible to position and hold board 6 in a state of warping depending on the warpage of rod lens array 2 (more specifically, such that the displacement amount is twice the warpage amount). Thus, light from LED array chip 5 can focus on focus surface F (surface of photoconductive drum 13) even when rod lens array 2 warps. In other words, it is possible to suppress a failure of image formation and to improve image quality.

As described above, in the seventh embodiment of the invention, since holder 3 includes multiple cured bodies 7 in the X direction and board contact surfaces 7*a* of cured bodies 7 are located at heights (positions in the Z direction) depending on the warpage of rod lens array 2, it is possible to cause light to focus on focus surface F even when rod lens array 2 warps. Thus, a failure of image formation can be suppressed and image quality can be improved. As a consequence, it is possible to reduce the warpage of rod lens array 2 and to reduce the manufacturing costs the LED head (exposure device).

Note that the seventh embodiment can also be combined with any of the first modified examples of the first embodiment, the second embodiment, the third embodiment, the fourth embodiment, the fifth embodiment, and the sixth embodiment.

In each of the embodiments described above, the UV-curable material (such as the acrylic adhesive) is used as curable material 71. However, the invention is not limited to this configuration. For example, any of a curable material which is cured by the addition of a cure accelerator (such as a two-liquid mixing adhesive), a curable material which is cured with the passage of time, and a curing agent which is cured with a change in temperature can be used therein.

In other words, curable material 71 only needs to be a material which is deformable when pressed between holder 3 and reference surface 51 of jig 50 and is cured afterwards.

In the meantime, although holder 3 is made of the sheet metal material in the embodiments, the invention is not limited to this configuration. Holder 3 may be made of an aluminum die-cast body, or of a plastic injection-molded body, for example.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An exposure device comprising:

a board on which light emitting elements are arranged;

an optical system comprising one or more lenses disposed opposite to the board;

a support member comprising: a pair of side walls, each side wall of the pair of side walls including a hold part that holds the board; and a support portion which connects to the pair of side walls and supports the optical system; and a cured body disposed on each of the hold parts of the pair of side walls of the support member and including a board contact surface that comes into contact with the board such that the cured body is disposed between the board and each of the hold parts in an optical axis direction of the one or more lenses, wherein the cured body is formed by curing a deformable material.

2. The exposure device according to claim 1, wherein the cured body includes a plurality of cured bodies, wherein the plurality of cured bodies are disposed on the support member along a direction parallel to a direction of arrangement of the light emitting elements.

3. The exposure device according to claim 1, wherein the hold part is formed by bending a given portion of each side wall of the pair of side walls.

4. The exposure device according to claim 3, wherein the hold part includes a groove portion, and a part of the cured body is provided in the groove portion.

5. The exposure device according to claim 4, wherein the hold part includes an end portion opposed to a central part of the board in a direction orthogonal to a direction of arrangement of the light emitting elements, and the groove portion is formed in the end portion.

6. The exposure device according to claim 1, wherein the hold part is formed as an opening formed at each side wall of the pair of side walls, and the cured body is formed at each of the openings at each side wall of the pair of side walls.

7. The exposure device according to claim 1, wherein the cured body includes a flat surface orthogonal to the board contact surface.

8. The exposure device according to claim 1, wherein the cured body is formed by curing an adhesive.

9. The exposure device according to claim 1, wherein the cured body is made of a resin to be cured by ultraviolet irradiation.

10. The exposure device according to claim 1, wherein the support member is made of a sheet metal material.

11. An exposure device comprising:

a board on which light emitting elements are arranged;

an optical system comprising one or more lenses disposed opposite to the board;

a support member comprising: a pair of side walls, each side wall of the pair of side walls including a hold part that holds the board; and a support portion which connects to the pair of side walls and supports the optical system; and a cured body disposed on each of the hold parts of the pair of side walls of the support member and including a board contact surface that comes into contact with the board, wherein the cured body is formed by curing a deformable material, and wherein a flatness of the board contact surface is equal to or below 100 μm.

12. An exposure device comprising:

a board on which light emitting elements are arranged;

an optical system comprising one or more lenses disposed opposite to the board;

a support member comprising: a pair of side walls, each side wall of the pair of side walls including a hold part that holds the board; and a support portion which connects to the pair of side walls and supports the optical system; and a cured body disposed on each of the hold parts of each side wall of the pair of side walls of the support member and including a board contact surface to come into contact with the board, wherein the cured body is formed by curing a deformable material, and wherein a dimension or an area of each of the board contact surface and a surface of the cured body opposite from the board contact surface is larger than a dimension or a cross-sectional area of a cross section at a central part of the cured body.

13. An exposure device comprising:

a board on which light emitting elements are arranged;

an optical system comprising one or more lenses disposed opposite to the board;

a support member comprising: a pair of side walls, each side wall of the pair of side walls including a hold part that holds the board; and a support portion which connects to the pair of side walls and supports the optical system; and a cured body disposed on each of the hold parts of the support member and including a board contact surface to come into contact with the board, wherein the cured body is formed by curing a deformable material, and wherein a dimension or an area of the board contact surface of the cured body is smaller than a dimension or an area of a surface of the cured body opposite from the board contact surface.

14. An exposure device comprising:

a board on which light emitting elements are arranged;

an optical system comprising one or more lenses disposed opposite to the board;

a support member comprising: a pair of side walls, each side wall of the pair of side walls including a hold part that holds the board; and a support portion which connects to the pair of side walls and supports the optical system;

a cured body disposed on each of the hold parts of the support member and including a board contact surface to come into contact with the board, wherein the cured body is formed by curing a deformable material;

an opening formed at a position opposed to the cured body in the support member; and a shield member attached to the support member, the shield member closing the opening, wherein the shield member includes an adhesion layer in contact with the support member, and a part of the adhesion layer that is not in contact with the support member is exposed through the opening.

15. The exposure device according to claim 14, wherein the adhesion layer of the shield member is disposed in a range in an optical axis direction of the optical system, the range being from a first surface of the board on which the light emitting elements are formed to a second surface of the board on an opposite side of the first surface.

16. The exposure device according to claim 14, wherein the adhesion layer of the shield member is disposed opposite to each of both end portions of the board in a width direction orthogonal to a direction of arrangement of the light emitting elements.

17. An exposure device comprising:

a board on which light emitting elements are arranged;

an optical system comprising one or more lenses disposed opposite to the board;

a support member comprising: a pair of side walls, each side wall of the pair of side walls including a hold part that holds the board; and a support portion which connects to the pair of side walls and supports the optical system; and a cured body disposed on each of the hold parts of the pair of side walls of the support member and including a board contact surface that comes into contact with the board, wherein the cured body is formed by curing a deformable material, the cured body includes a plurality of cured bodies disposed on the support member along a direction parallel to a direction of arrangement of the light emitting elements, and the cured bodies are formed to vary from each other in height in the optical axis direction of the optical system.

* * * * *